US007464840B1

(12) United States Patent
Park

(10) Patent No.: US 7,464,840 B1
(45) Date of Patent: Dec. 16, 2008

(54) GARMENT PRESSER WITH SHOULDER EXTENDER

(76) Inventor: Kwang Hun Park, 4205 Laystonsville Rd., Olney, MD (US) 20832

( * ) Notice: Subject to any disclaimer, the term of this patent is extended or adjusted under 35 U.S.C. 154(b) by 0 days.

(21) Appl. No.: 11/779,100

(22) Filed: Jul. 17, 2007

(51) Int. Cl.
*D06F 71/26* (2006.01)
*D06F 71/36* (2006.01)

(52) U.S. Cl. ..... 223/70; 223/74; 38/16

(58) Field of Classification Search ..... 223/68–74; 38/14–16

See application file for complete search history.

(56) References Cited

U.S. PATENT DOCUMENTS 2,805,009 A * 9/1957 Jackson ..... 223/67
3,033,429 A * 5/1962 Richterkessing ..... 223/68
3,568,900 A * 3/1971 Paris ..... 223/70
3,583,610 A * 6/1971 Forse ..... 223/57
3,715,064 A * 2/1973 North et al. ..... 223/57
3,749,292 A * 7/1973 Engelbart ..... 223/57
4,728,015 A * 3/1988 Holzapfel et al. ..... 223/70
5,148,955 A * 9/1992 Cares ..... 223/70
5,722,572 A * 3/1998 Pessina ..... 223/70

* cited by examiner

*Primary Examiner*—Ismael Izaguirre
(74) *Attorney, Agent, or Firm*—Birch, Stewart, Kolasch & Birch, LLP

(57) ABSTRACT

A garment-pressing device for shirts or blouses employs a buck having shoulder extenders which are movable between a retracted position and one or more extended positions. The shoulder extenders have a soft element that may be made from one or more air bags or chambers, or of a plurality of layers of flexible material, and can be driven pneumatically, mechanically and/or electrically in a stepped or continuous manner. The shoulder extenders are mover simultaneously with buck side air bags. Platen side extenders that operate in conjunction with the shoulder extenders to press shirt shoulders are also provided.

12 Claims, 42 Drawing Sheets

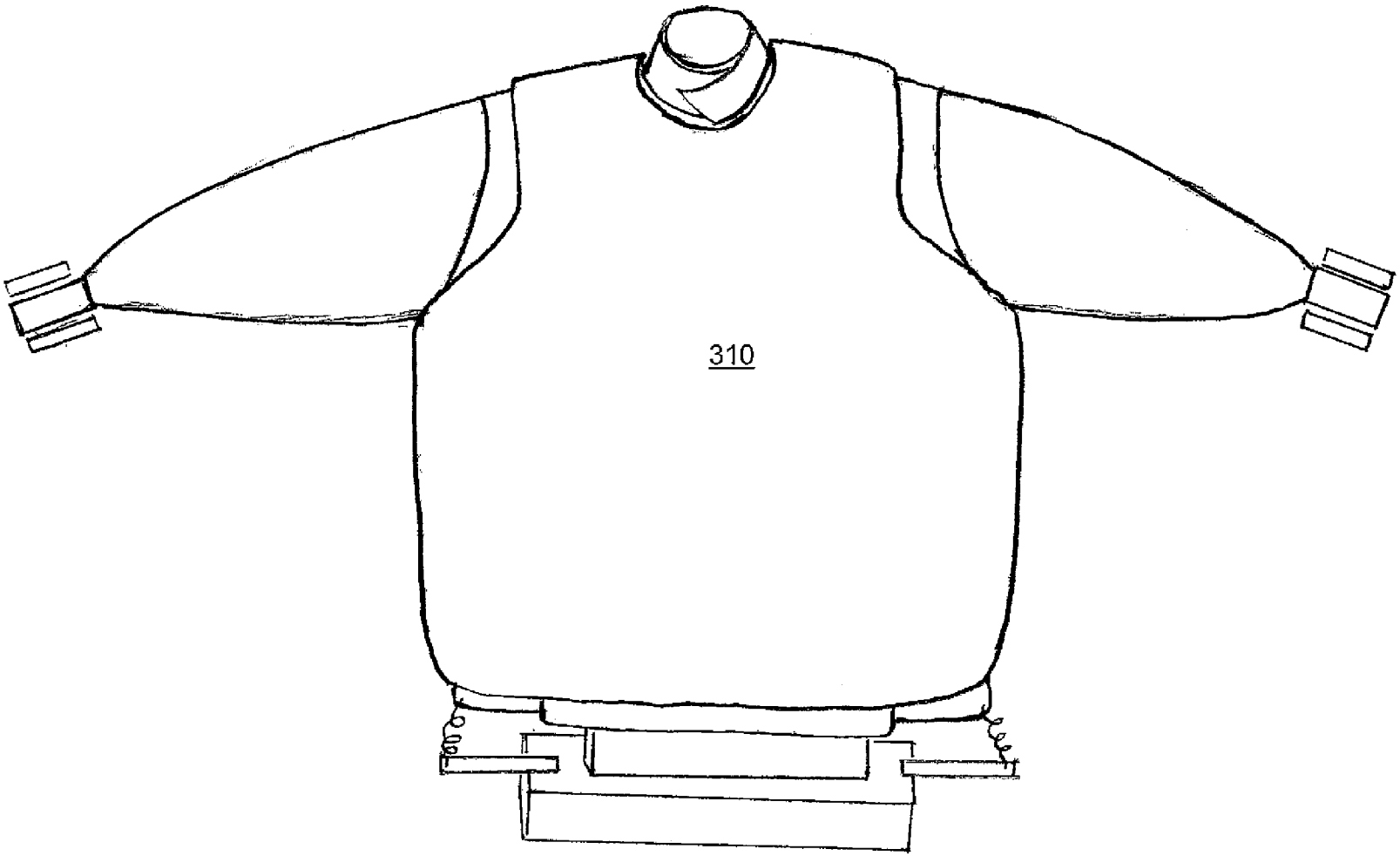
FIG.3A1

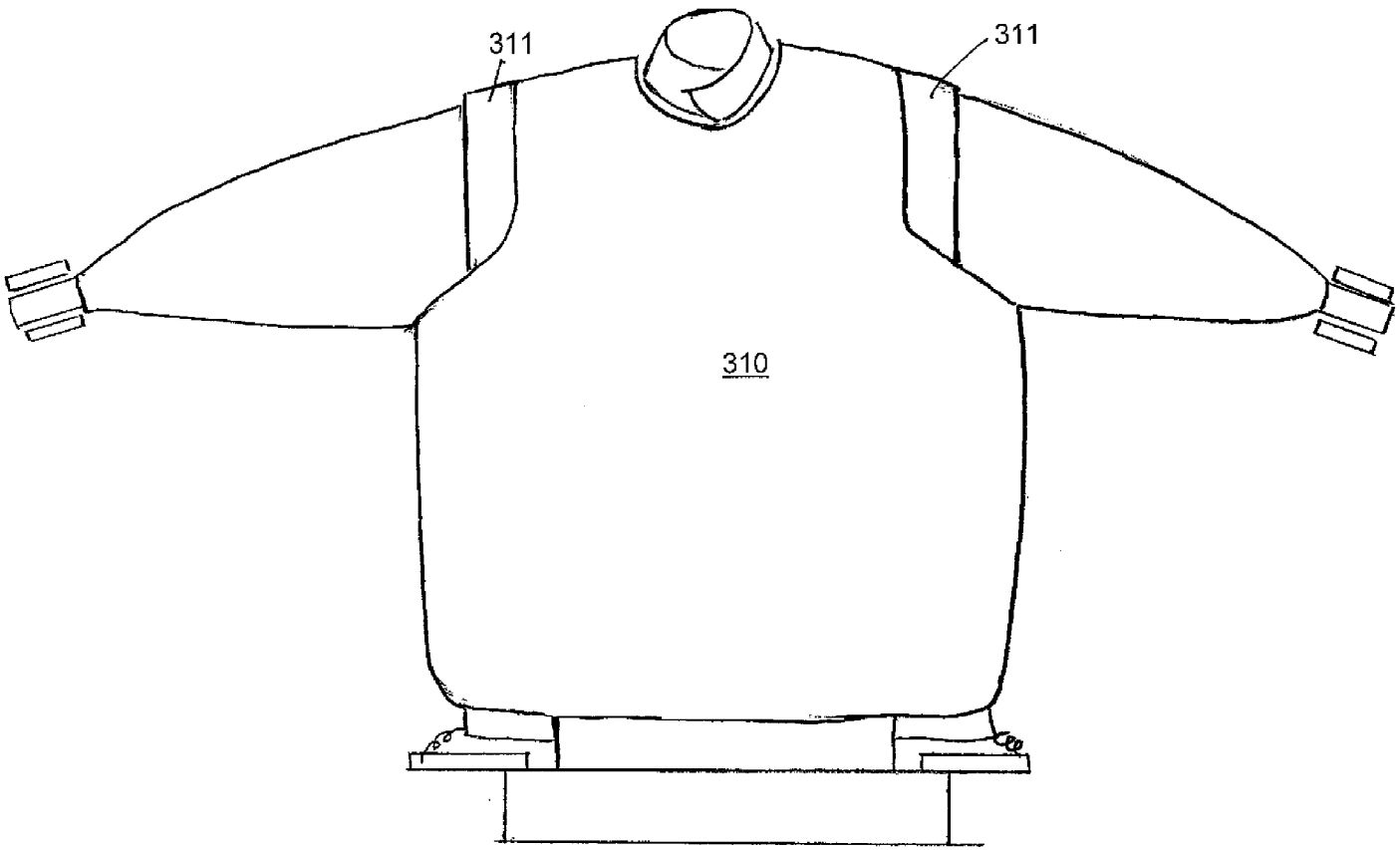
FIG.3A2

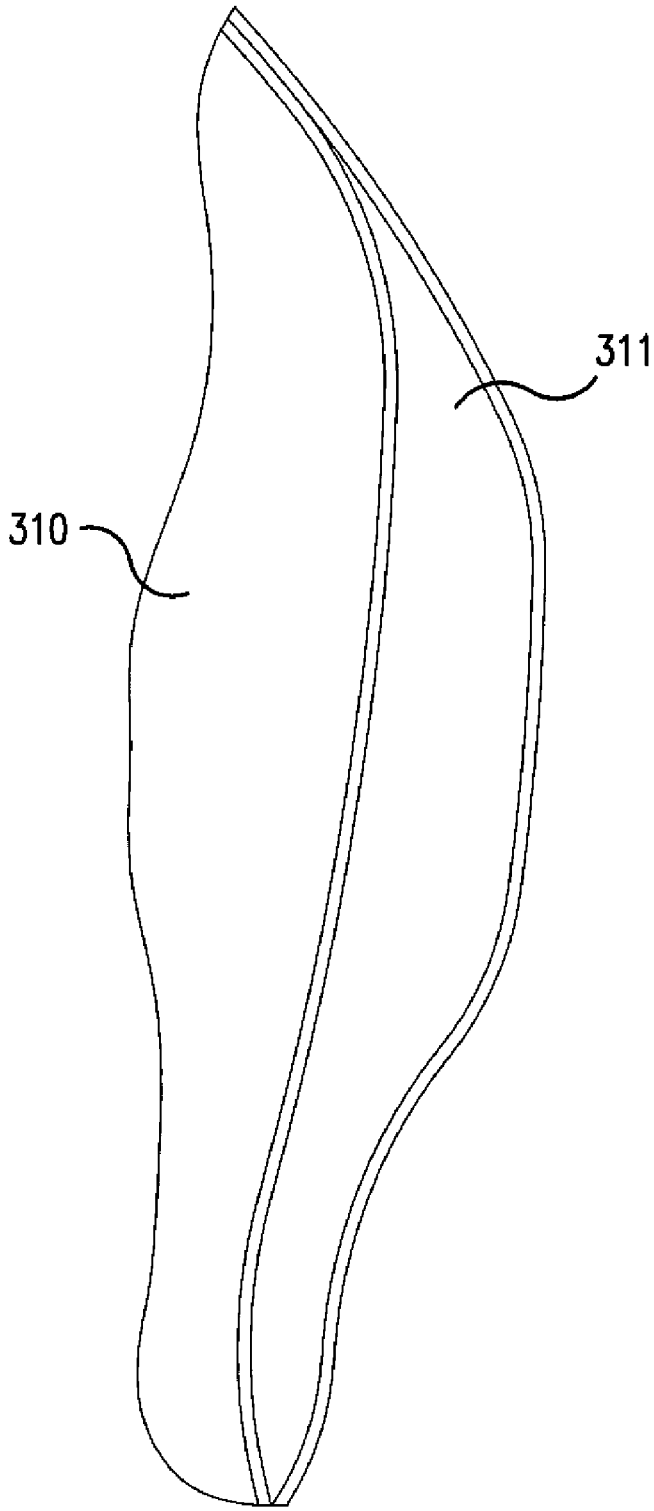
FIG.3B1

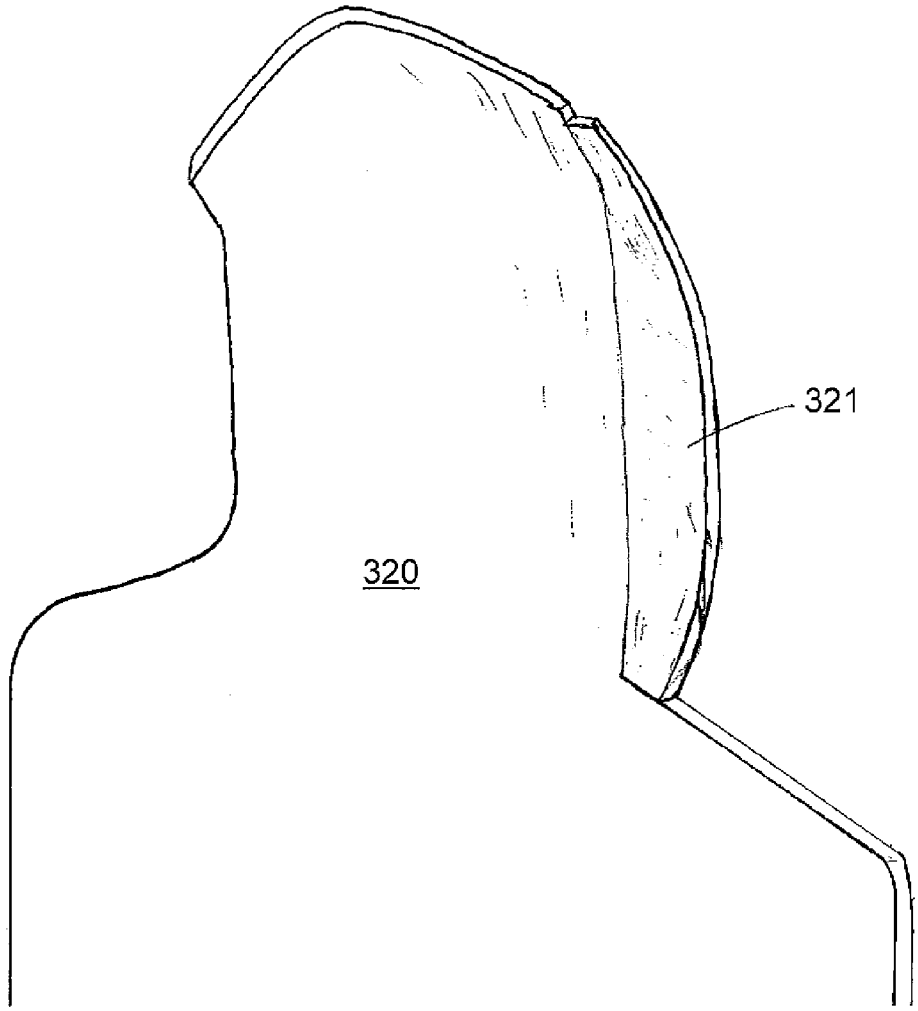
FIG.3B2

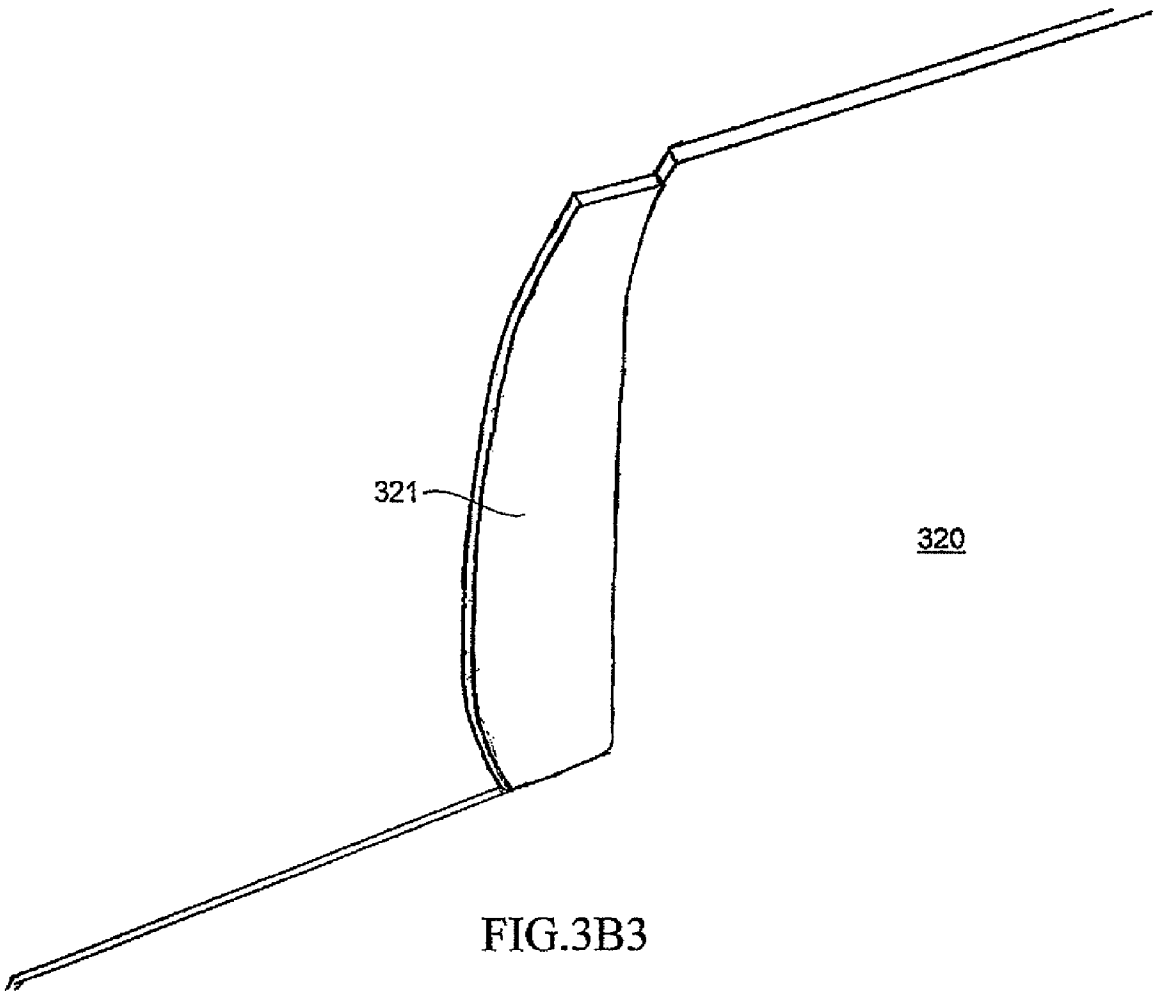
FIG.3B3

GARMENT PRESSER WITH SHOULDER EXTENDER

BACKGROUND OF THE INVENTION

Garment pressing devices take many shapes and forms. One category of garment pressing devices includes devices for ironing shirts, blouses and similar articles of clothing. Typically, shirt-pressing devices include a shirt mannequin or form, conventionally referred to as a buck. The buck has the form of a shirt wearer with front, back and opposing lateral sides therebetween on which a shirt or blouse or similar garment, referred to hereinafter as a shirt, is placed and fitted. Many bucks have shirt shoulder rods that are extended outward from the opposing lateral sides of the buck to support the shoulders of a shirt in proper orientation during an ironing operation and are connected to air bags that are moved outward into an inflated or extended position from the opposing sides of the buck by the extension of the shoulder rods, which are movable between extended and retracted positions, the shoulder rods being attached to the air bags by, for example, a spring and/or a tether to expand the shirt body during operation of the garment pressing device. In normal operation of the garment-pressing device, the shoulder rods are retracted, as are the side air bags to permit an ironed shirt to be easily removed from the buck and to facilitate placement of a shirt on the buck prior to being pressed.

Typically, these garment pressing devices include a fan or blower for blowing room air, which may be filtered, to facilitate drying of the shirt and to inflate the aforementioned air bags to expand shirts whose widths are larger than the width of the buck during operation of the garment pressing device. The air may be heated, if desired, using a conventional air heater. Also, the air can be blown into the sleeves of the shirt to inflate and dry the sleeves while the body of the shirt is pressed using heated plates or platens that are movable toward and away from a shirt on the buck.

Some shirt pressers operate using pneumatic controls that employ compressed air provided by an air compressor, with heated platens being moved relative to the buck using conventional pneumatic circuits and controls. Semi-automatic operation is typical, providing control over the relative movement between the buck and the platens to an operator using suitable controls, e.g., foot pedals and hand controller switches and levers. Such circuits and controls may include, for example, air pumps, air compressors, electrical and pneumatic motors, pump controls, motor controls, pneumatic circuits, electrical and electronic circuits, pneumatic controller (s) and electrical/electronic controller(s).

Prior art shirt-pressing devices may employ inflatable side air bags that are designed to permit ironing of shirt bodies of different sizes, including shirts that are larger in width and diameter than the width and diameter of the buck. However, such devices still have problems in producing acceptably ironed shirts. For example, operation of prior art shirt-pressing devices occasionally result in pressed shirts having areas which are not properly pressed. For example, shirt seams where shirt sleeves join the shirt body often are not properly pressed. These seams, when pressed, may have undesired creases, or these seams may not be fully pressed. Moreover, portions of the shirt sleeves and/or shirt body adjacent to these seams often have creases or are not fully pressed, and/or the seams and sleeves and adjacent shirt body may have a puckered appearance after being pressed. Some of these problems are attributable to the differing sizes of shirts, especially large sized shirts, not being properly smoothed by prior art shirt pressing devices prior to being pressed.

SUMMARY OF THE INVENTION

The apparatus, systems and methods of this invention attempt to reduce occurrences of the aforementioned, and similar, problems by providing shirt pressing devices which employ expandable and retractable shirt pressing buck shoulder expanders, platen extensions, and air bag extenders.

While the shoulder expanders may work independently of, or in conjunction with, the air bag extenders, various exemplary embodiments of the apparatus, systems and methods of this invention employ a combined stage shoulder expander and air bag extender.

In various exemplary embodiments of the apparatus, systems and methods of this invention, a single-stage movement operation shoulder expander and air bag extender is provided.

In various other exemplary embodiments of the apparatus, systems and methods of this invention, a multiple-stage movement operation shoulder expander and air bag extender are provided.

In various exemplary embodiments of the systems, apparatus and methods of the invention, expanded/extended heating platens are provided. In various exemplary embodiments, platen extensions or expanded portions may be curved differently than the curvature of the main body of the platens and may lie in a plane that is at an angle to the plane in which the main body a platen lies. For example, a platen extension may extend from the main body of the platen in a direction away from the buck on which a shirt is placed to be pressed. In any event, even though the platen extensions may have the same curvature as the main body of the platen, Applicant has found that improved pressing properties are achieved when the platen extensions slope away from the buck so that the surfaces of the heating platen extensions are not parallel to the surfaces of the platens and are not parallel to the surfaces of the buck. In various exemplary embodiments, the platen shoulder extensions have a curved, e.g., arcuate, cross sectional shape in end view. This platen extension shapes work in unison with various exemplary embodiments of the shoulder expanders to result in improved pressing of shirts.

Various exemplary embodiments of shirt expanders according to this invention have several components. In the single inflatable expander element embodiments, a single, movable, expander frame is provided. In the multiple inflatable expanded element embodiments, two or more separate, nested expander frames are involved.

In various exemplary embodiments, the shoulder expanders include one or more inflatable chambers.

In various other exemplary embodiments, the shoulder expander support element has a layered structure of flexible material.

In various exemplary embodiments of the apparatus, systems and methods of the invention, the movable shoulder expanders have one of more movable support frames. Each movable support frame has a U-shaped cross-section. In various exemplary embodiments of the invention, pneumatic circuits made up of air compressor(s), hoses, valves, pistons high pressure are employed to operate the garment-pressing device. These pneumatic circuits may be operated manually, or have control circuitry to be operated semi-automatically.

OBJECTS OF THE INVENTION

One object of the invention is to provide an expandably and retractably mounted shoulder/sleeve expansion support mechanism that includes expandable side air bags to result in ironing of shirts and blouses of differing widths in an effective manner, i.e., in a manner that reduces the occurrence of puckered fabric and/or fabric creasing pressed/ironed into the shirts and blouses.

Another object of the invention is to provide an arcuate platen expansion extension which is set at an angle to the plane of the front heated platen of a buck type shirt press to accommodate the expansion of the shirt shoulder/sleeve area caused by the aforementioned shoulder/shirt expansion support mechanism, so that the occurrence of puckered fabric and or fabric creasing pressed/ironed into the shirt or blouse is reduced.

Another object of the invention is to provide systems, apparatus and methods for reducing creasing and/or puckering in the shoulder and sleeve portions of shirts and/or blouses ironed by buck-style shirt/blouse presses/ironers.

Another object of the invention is to provide systems, apparatus and methods for reducing creasing and/or puckering in shirts of different sizes ironed by buck-style shirt/blouse presses/ironers.

Another object of the invention is to provide continuously and/or incrementally adjustable buck-style ironing systems, apparatus and methods for reducing creasing and/or puckering in shirt of different sizes.

Another object of the invention is to provide modified shirt/blouse buck-type press/ironers that reduce creasing and/or puckering in shirts of different sizes, and which have operating system components including pneumatic drive systems.

BRIEF DESCRIPTION OF THE DRAWINGS

FIGS. 3A1 and 3A2 are front perspective views of one exemplary embodiment of a shirt pressing device of the invention showing a front platen having a shoulder platen extender pressing a shirt which is mounted on a shirt pressing buck;

FIGS. 3B1-3B3 are perspective views of a platen having a shoulder expanded platen element;

DETAILED DISCLOSURE OF THE INVENTION

Figure 1:
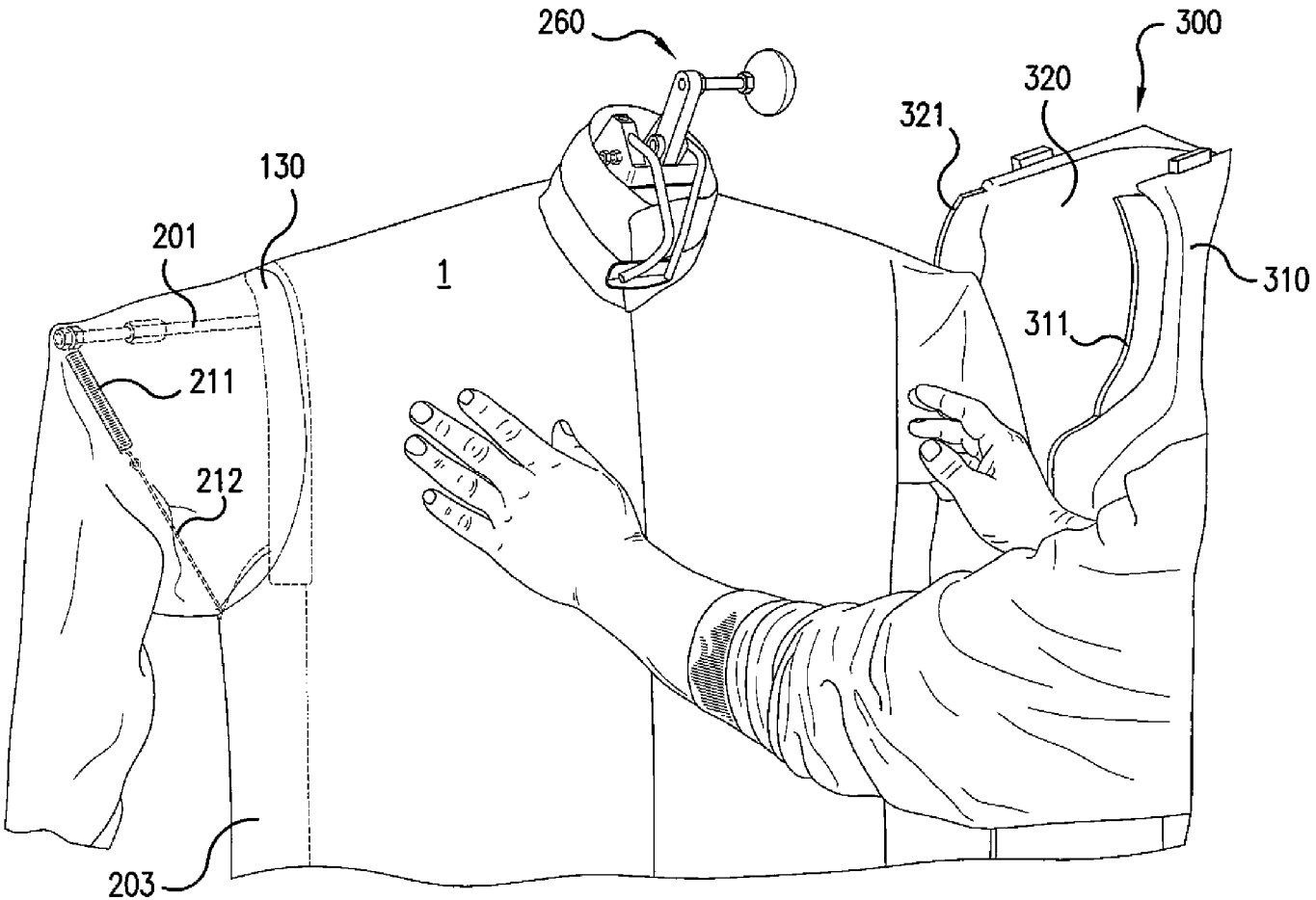
FIG. 1 is a perspective view of a shirt-pressing device according to the invention showing a shirt ready to be pressed by a user.

FIG. 1 shows shirt-pressing device 100 according to the invention with a shirt 1 ready to be pressed by a user. The shirt presser 100 has a buck 200 and a platen assembly 300 which are movable with respect to one another. The buck 200 includes a clamping assembly 260 which is used to clamp a shirt 1 placed on the buck 200 at its collar portion to the buck 200 for pressing.

In this exemplary embodiment of the invention, the buck 200 includes a shoulder rod 201, which is connected via a spring 211 and tether 212 to a side air bag 203. The buck 200 also includes a shoulder extender 130, which movably extends from the shoulder portion of the buck 200 to expand the surface area of the buck 200 in the shoulder area of the buck 200. The platen assembly 300 has a front platen 310 and a rear platen 320, and is provided with front and rear platen shoulder extensions 311 and 321.

In operation, the buck 200 and the platen assembly 300, which are movable with respect to one another, are moved to coincide so that the buck 200 fits between the front platen 310 and back platens 320 of the platen assembly 300. The platen assembly 300 is moved to come in contact with, and press a garment, e.g., shirt, 1 mounted on the buck 200. Then the platens 310 and 320 are withdrawn away from the buck 200 and the platen assembly is moved relative to the buck so that the buck 200 and platen assembly 300 are no longer aligned with one another but are separated from one another in a sideways direction. This permits a user to remove the pressed shirt and mount another shirt on the buck 200 for pressing by the platen assembly 300.

Figure 2C:
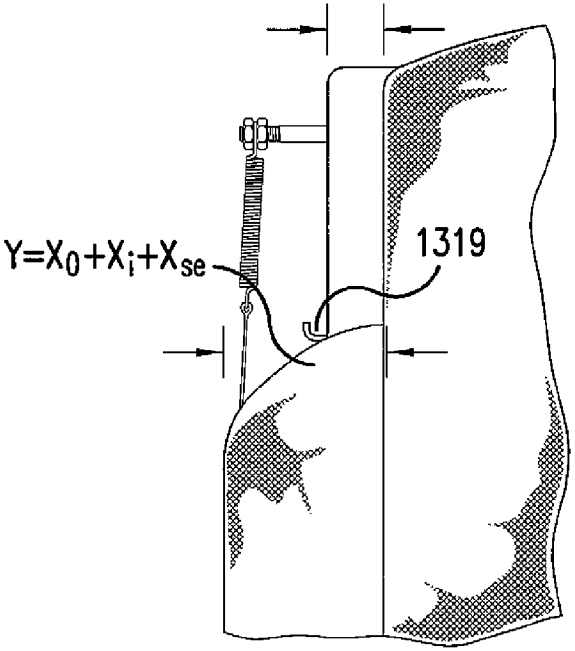
FIGS. 2A-2C are front perspective views of one exemplary embodiment of a shirt pressing buck of the invention with a shoulder expander showing, respectively, a side air bag retracted stage, a side air bag expanded stage, and a side bag plus shoulder expanded stage.
Figure 2B:
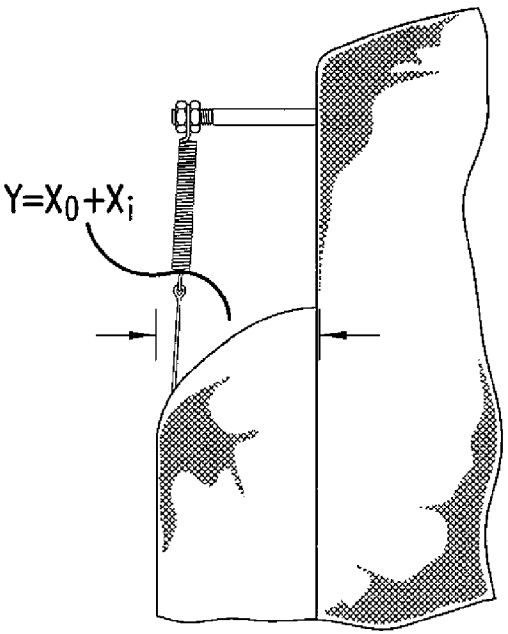
Figure 2A:
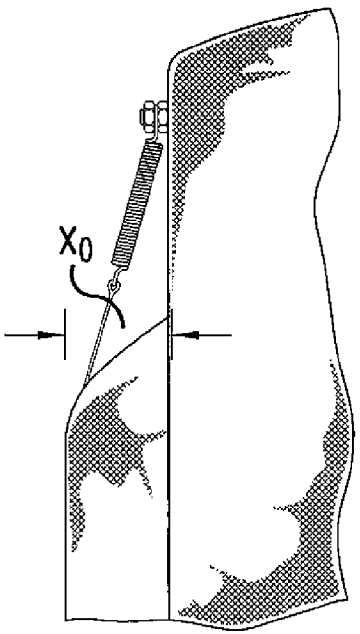

FIG. 2A shows an exemplary embodiment of the buck 200 of this invention in which the side air bag 203 is in its normal, uninflated position, and in which the shoulder rod 201 is in its fully retracted position. In this embodiment, the air bag may extend out in its draped, uninflated state, a short distance $X_O$ from the side of the buck 200.

FIG. 2B shows this exemplary embodiment of the buck 200 when the shoulder rod 201 is in a fully extended position and when the shoulder extenders 130 (shown in FIG. 1) are retracted. The side air bag 203 is shown as extending out a distance $Y=X_O+X_i$.

Figure 6A:
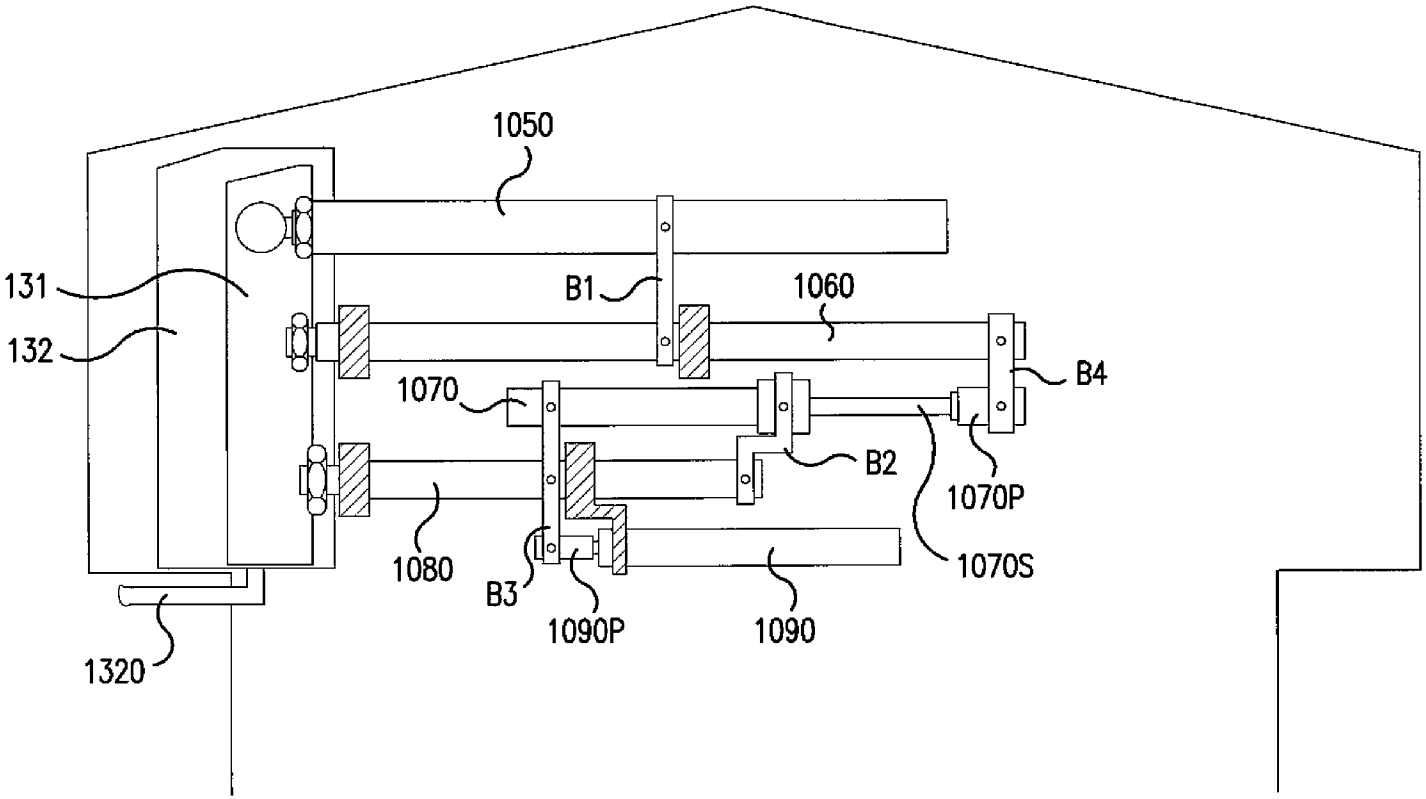
FIGS. 6A-6C are cutaway views of an exemplary embodiment of a two stage buck shoulder expansion mechanism showing, respectively, a retracted position, a first expanded position and a second expanded position, including pneumatically operated elements thereof.
Figure 6B:
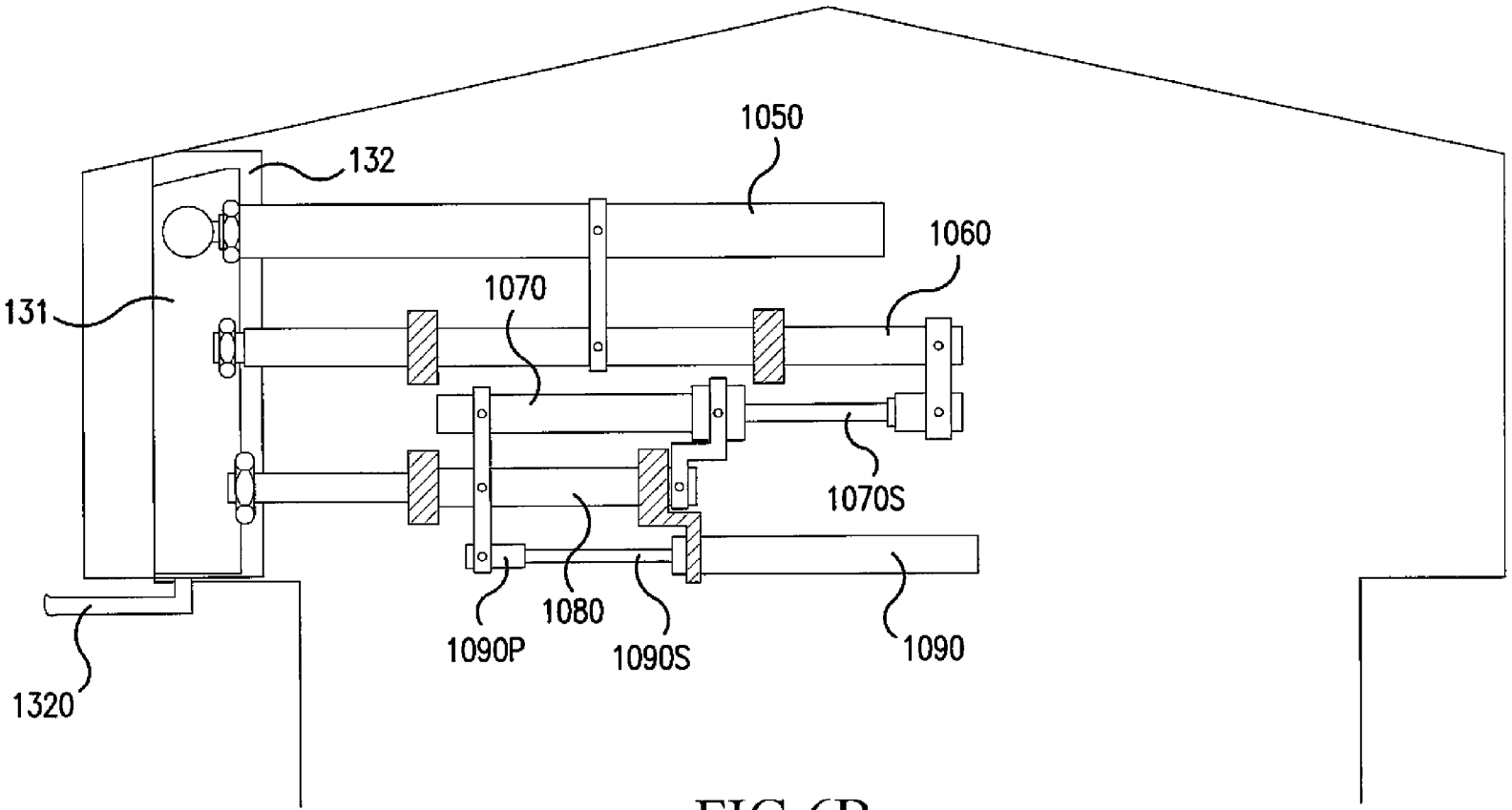
Figure 6C:
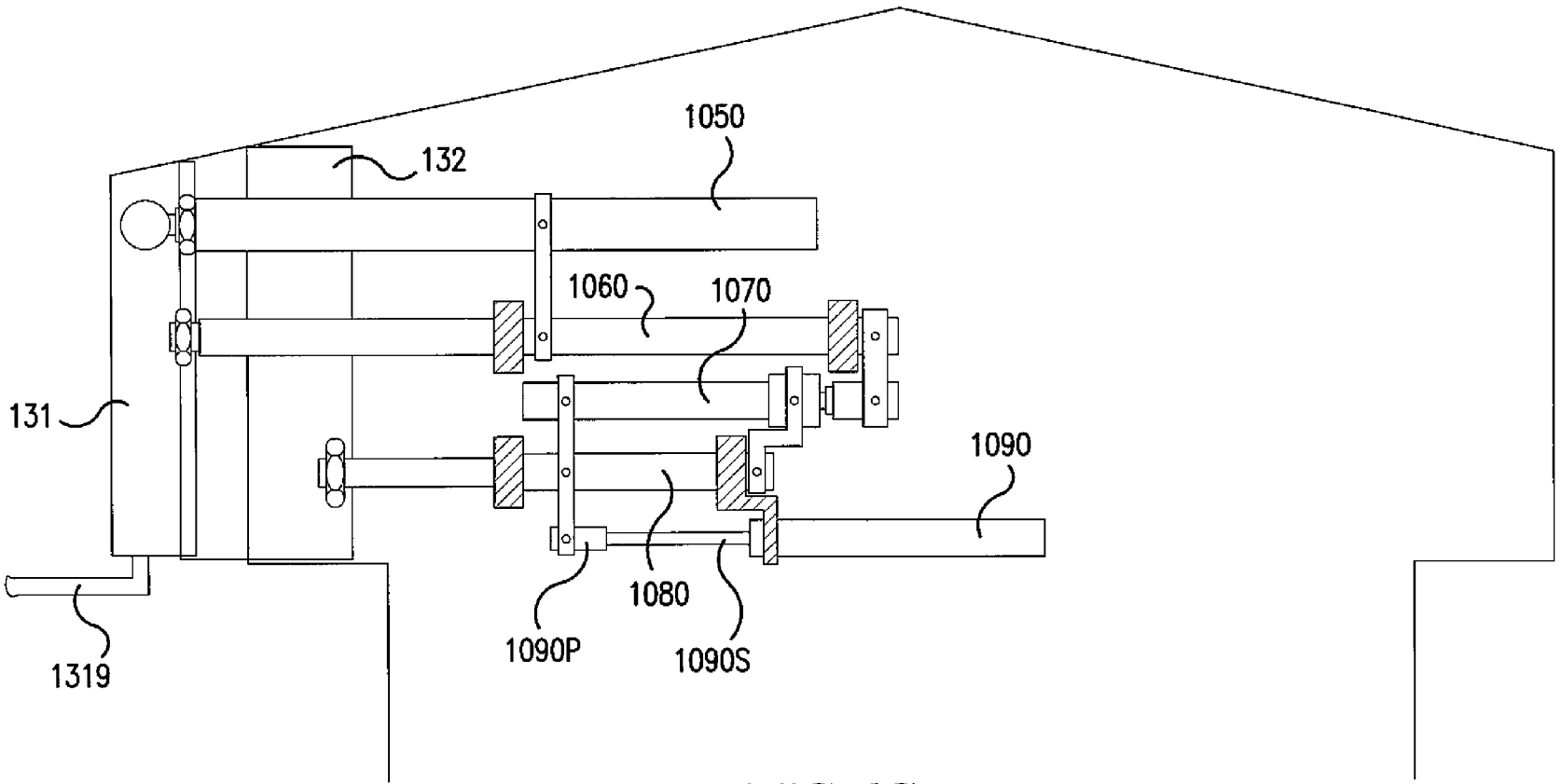

FIG. 2C shows this exemplary embodiment of the buck 200 when the shoulder rod 201 is in a fully extended state, and also the shoulder expander extends a further distance $Y=X_O+X_i+X_{se}$, where the extra distance from the side of the buck 200 is the distance that the side air bag 203 and shoulder extender 132 moves first (carrying 131), then 131 moves by itself if necessary, were moved by the shoulder extender mechanism, which also includes a side air bag extender element 1319 (shown in FIGS. 6A-6C).

Figure 4A:
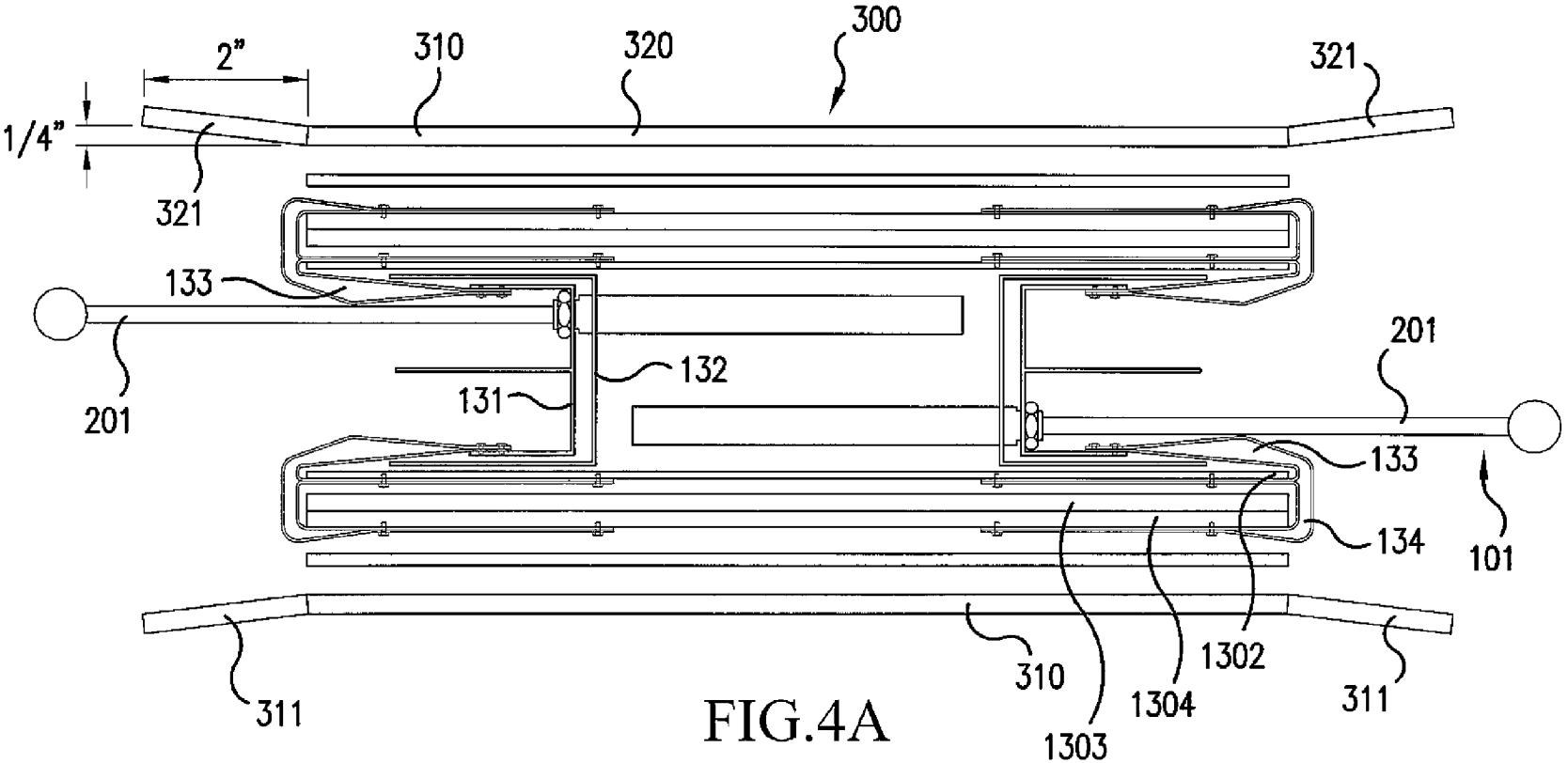
FIGS. 4A-4C are top schematic views of one exemplary embodiment of a shirt pressing device of the invention having a multiple stage air bag shoulder expander showing three different positions of the shoulder expander mechanism.
Figure 4B:
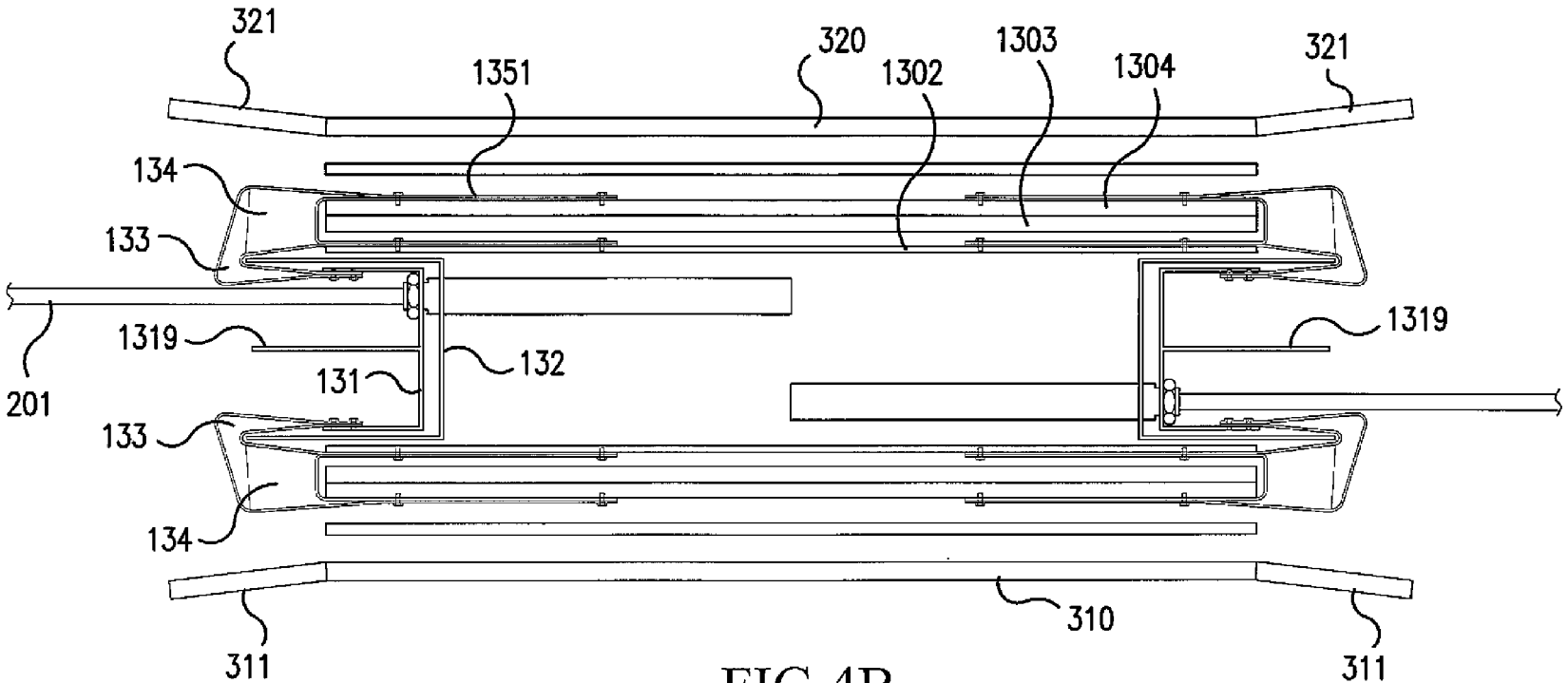
Figure 4C:
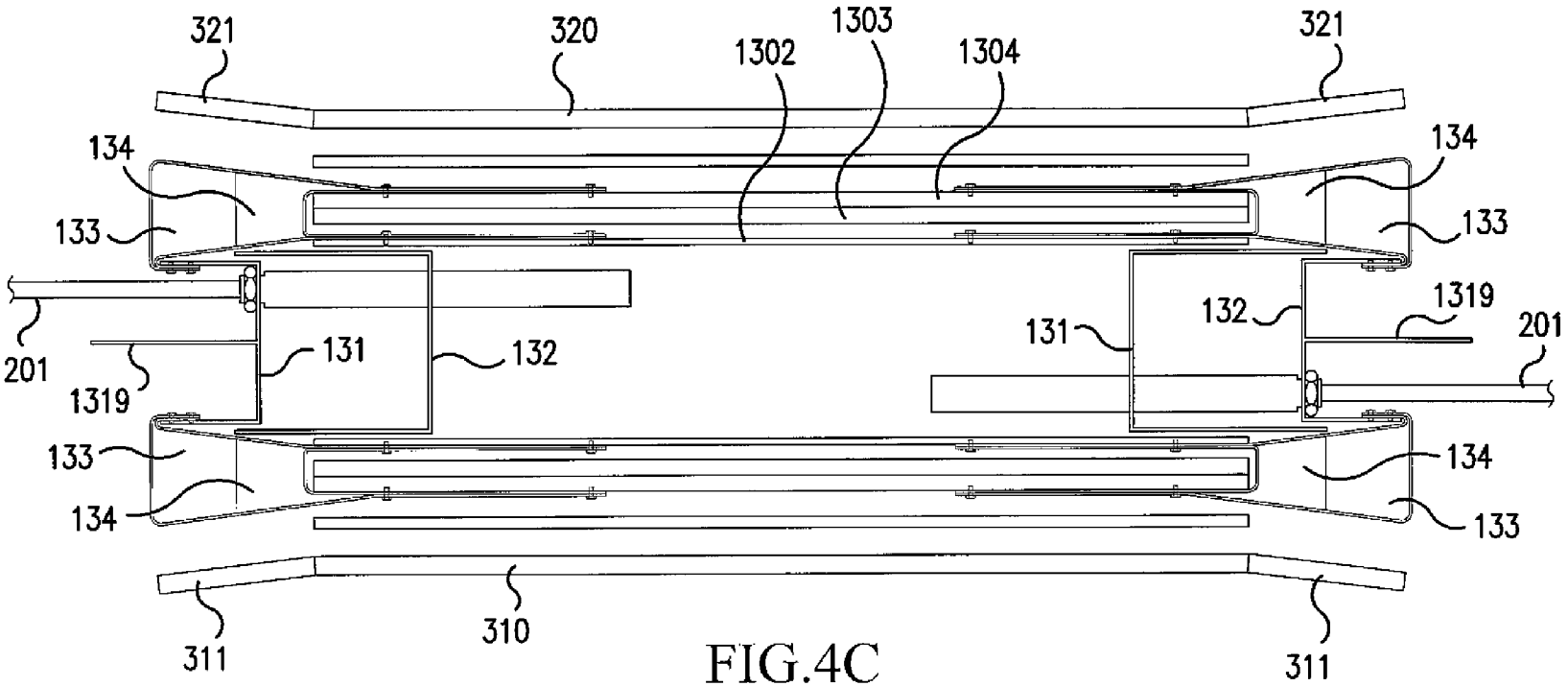

In the exemplary embodiment of the buck 200 shown in FIGS. 2A-2C, the buck shoulder extender mechanisms extend not only the buck shoulder extender elements 130, but also simultaneously extend the side air bags 203 (using the side air bag extender element 1319 (shown in FIGS. 4A-4C). This minimizes frictional contact between overlapping portions of the extender elements 130 and side air bags 203 when the shoulder extender elements 130 and side air bags 203 are moved, e.g., by being extended or retracted in operation of the shirt-pressing device 10. In this regard, while shoulder extender elements 130 can be extended or retracted while the aide air bags 203 remain stationary, or are retracted, and vice versa, this method of operation is workable, but it will result in sufficient frictional contact to cause premature wearing of the air bags and shoulder extender elements where they come into contact.

Figure 3C:
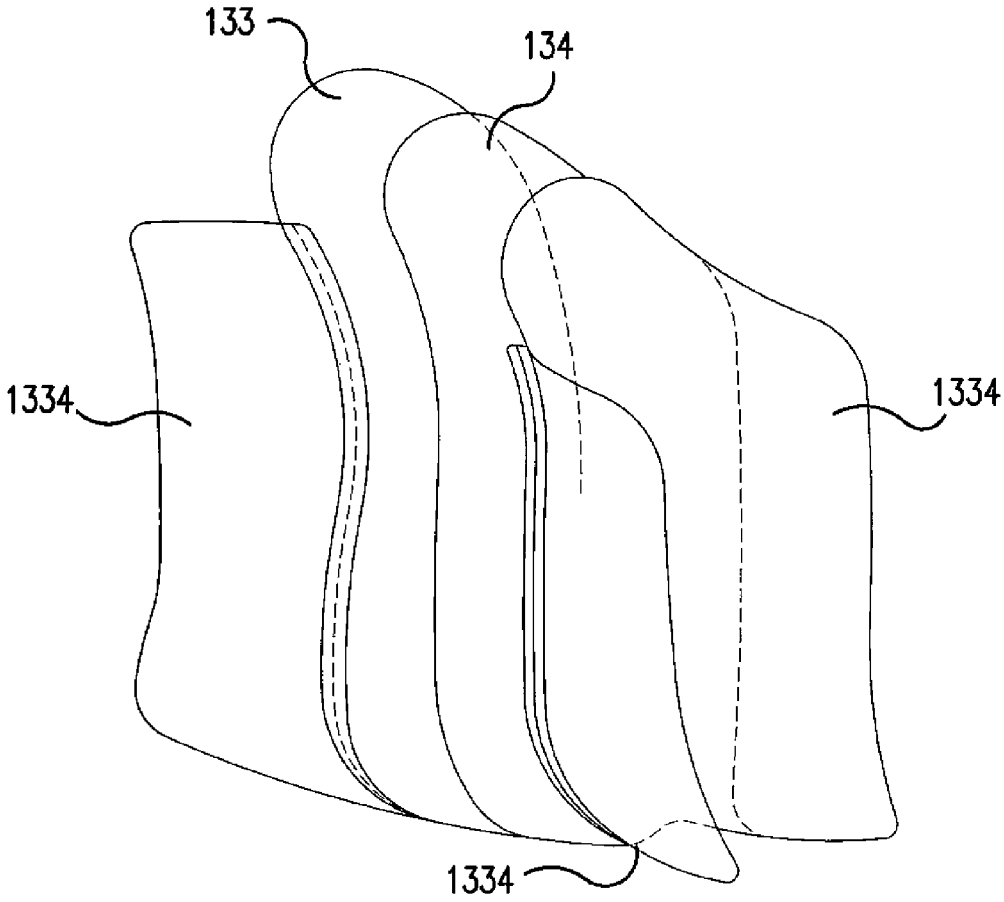
FIG. 3C is a perspective view of the shoulder expander bags.

FIG. 3A illustrates an exemplary embodiment of the shirt pressing device 10 of the present invention wherein the platens are pressing a shirt 1 and the front platen 310 is provided with a front platen shoulder extension 311.

FIG. 3B is a perspective view of an actual exemplary embodiment of the invention, showing the curvature of platens 310,320 and platen extensions 311, 321. As noted above, platen extensions 311, 321 may extend from the main body of the platen 300 in a direction away from the buck 200 on which a shirt is placed to be pressed. In any event, even though the platen extensions 311, 321 may have the same curvature as the main body of the platen, Applicant has found that improved pressing properties are achieved when the platen extensions 311, 321 slope away from the buck, so that the surfaces of the heating platen extensions are not parallel to the surfaces of the platens and are parallel to the extended surfaces of the buck. In various exemplary embodiments, the platen shoulder extensions 311, 321 are generally flat, and connect to the platen by a curved, e.g., arcuate portion. This platen extension shape works in unison with various exemplary embodiments of the shoulder expanders to result in improved pressing of shirts. One exemplary actual embodiment of the invention attaches platen extensions 311, 321 to the platen 300 by welding. However, any suitable form of attachment may be used, and the platen extensions may be formed as an integral portion of a platen 300 instead of an add-on or retrofitted element.

This shape is similar to the shape of the shoulder extender airbag embodiment shown in FIGS. 4A, 4B and 4C, which is discussed in detail, below.

FIGS. 4A, 4B and 4C are top schematic views of one exemplary embodiment of a shirt pressing device of the invention having a multiple stage air bag shoulder expander showing three different positions of the shoulder expander mechanism including first and second expander flames 131, 132, shoulder air bags 133 and 134, shoulder rods 201, buck 200, platens 310, 311, and side air bag extender brackets 1319 in expanded positions and in a retracted position of the shoulder expander air bags 133 and side air bags 203.

In this exemplary embodiment of the invention, each of the shoulder extenders 130 includes two airbags 133 and 134. The airbags 133 and 134 are mounted adjacent to one another at each end of the rigid frame 1302 and adjacent main layers of material. In various exemplary embodiments of the invention, the layer of material 1303 that is adjacent to rigid frame 1302 is an approximately ⅜ inch thick piece of silicone rubber, but may be made of any suitable resilient material with similar characteristics and suitable thickness. In various exemplary embodiments, the next layer, i.e., layer 1304 adjacent to the resilient layer 1303, may be made of a ¼ inch thick cotton pad, but may be made of any suitable backing material to cushion the pressing platens and to which an inflatable shoulder extender casing may be attached, e.g., by sewing or by pinning. Next to cotton pad 1304 is a thin layer of cotton fabric, which also covers flaps of the shoulder airbag 133.

Figure 8:
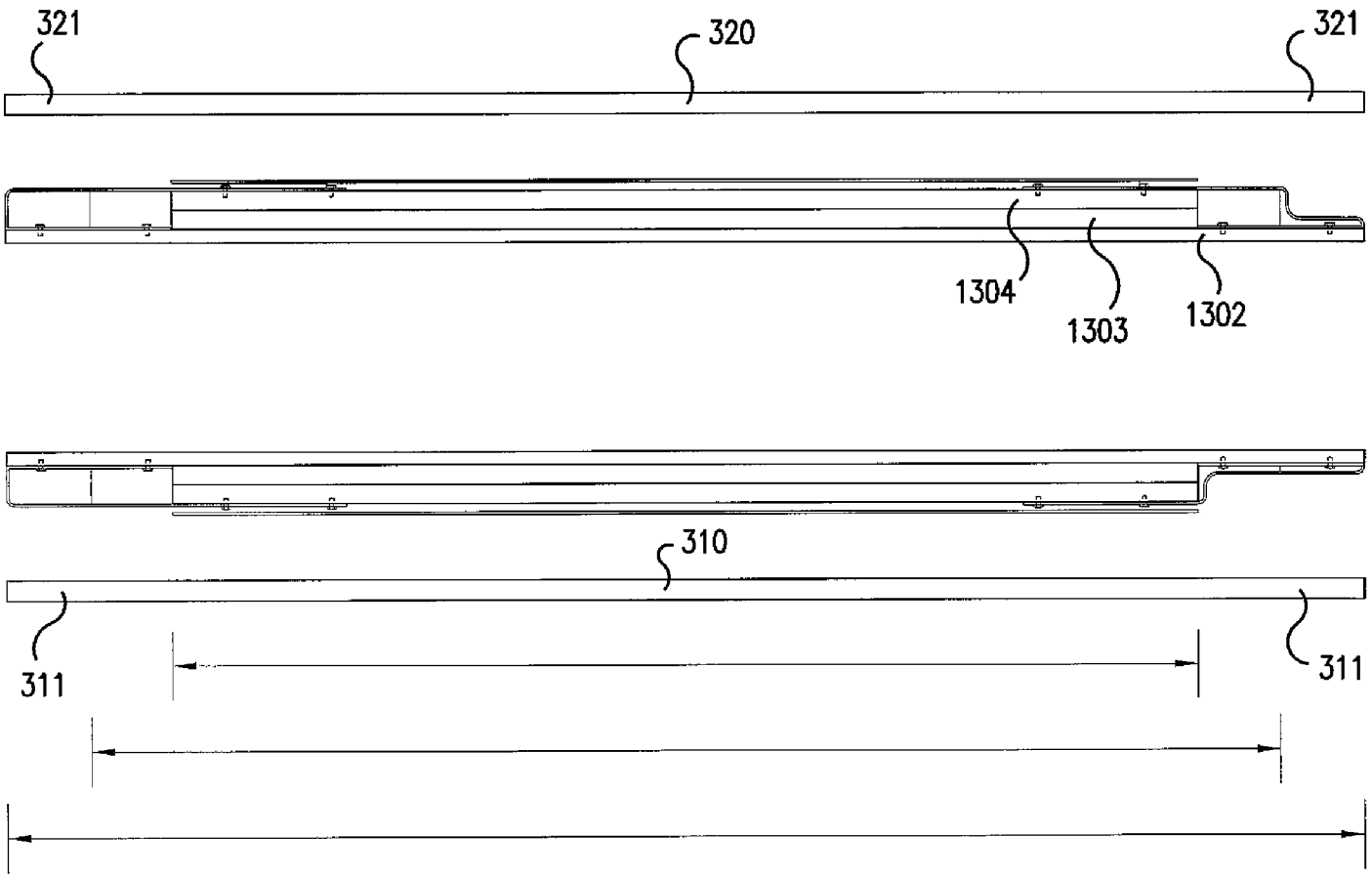
FIG. 8 is a top cutaway view of another exemplary embodiment of a shoulder expander buck of the invention.

FIGS. 4A, 4B and 4C also show an exemplary embodiment of the invention in which the platens 310 and 320 have extensions 311 and 321, that are angled away from the buck, although the extensions 311 and 321 may be non-angled (i.e. straight) as shown in FIG. 8. As shown in FIGS. 4A, 4B and 4C, the platen extensions appear to be parallel to the surface of shoulder extender. In actual practice, the outer surface of both the platen extensions 311 and 321 and the outer surface of the shoulder extender 130 may be flat and curved. An important feature of the invention is that these surfaces should have generally the same curvature so that when a shirt is pressed between a platen extension 311,321 and the corresponding shoulder extender 130, the shirt is pressed between surfaces that have similar shapes. In this way, wrinkling, puckering and creasing of shirts in the area where a shirt body and a shirtsleeve are joined is lessened.

FIGS. 4A, 4B and 4C also show shoulder extender air bag 133, 134 which are attached, e.g., by adhesive, or stitching, or other suitable fastening means, to the main layer 1304 and to the rigid inner frame 1302.

FIGS. 4A, 4B and 4C also show first shoulder extender frames 132, and second shoulder extender frames 131.

In FIG. 4A, both shoulder extender mechanisms 131, 132 are shown in their fully retracted positions. In this retracted position, the distance between the outside ends of both shoulder extender mechanisms is shown as $L_R$. In FIG. 4B, both shoulder extender mechanisms 131, 132 are shown in their first extended position which, in this exemplary embodiment, has the first air bag 134 inflated and extender mechanism frames 131, 132 deployed as shown in this figure. In this first extended position, the distance between the outside ends of both shoulder extender mechanisms 130 is shown as LIE. In FIG. 4C, both shoulder extender mechanisms 131, 132 are shown in their second extended position which, in this exemplary embodiment, has both the first airbags 134 and the second airbags 133 inflated and the first and second extender frames 132, 131 extended as shown in this figure. In this second extended position, the distance between the outside ends of both shoulder extender mechanisms 130 is shown as $L_{2E}$. As is evident from FIGS. 4A, 4B and 4C, $L_{2E}$ is greater than $L_{1E}$, which is greater than $L_R$.

Figure 4D:
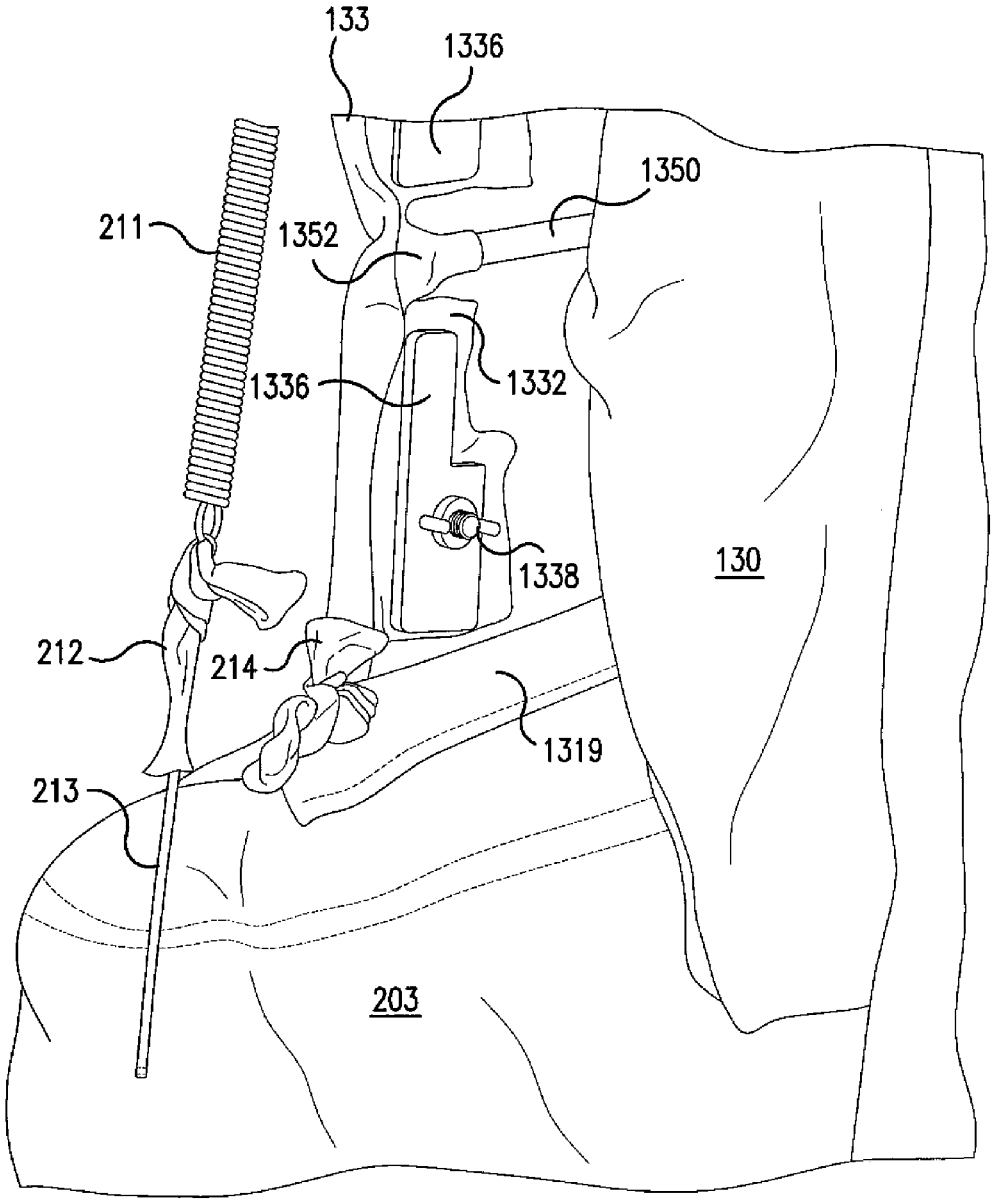
FIG. 4D is an angled perspective view of an exemplary embodiment of the invention showing details of the side air bag, two shoulder expander air bags, a shoulder air bag expander frame, and side air bag extender elements, in an expanded position.
Figure 4E:
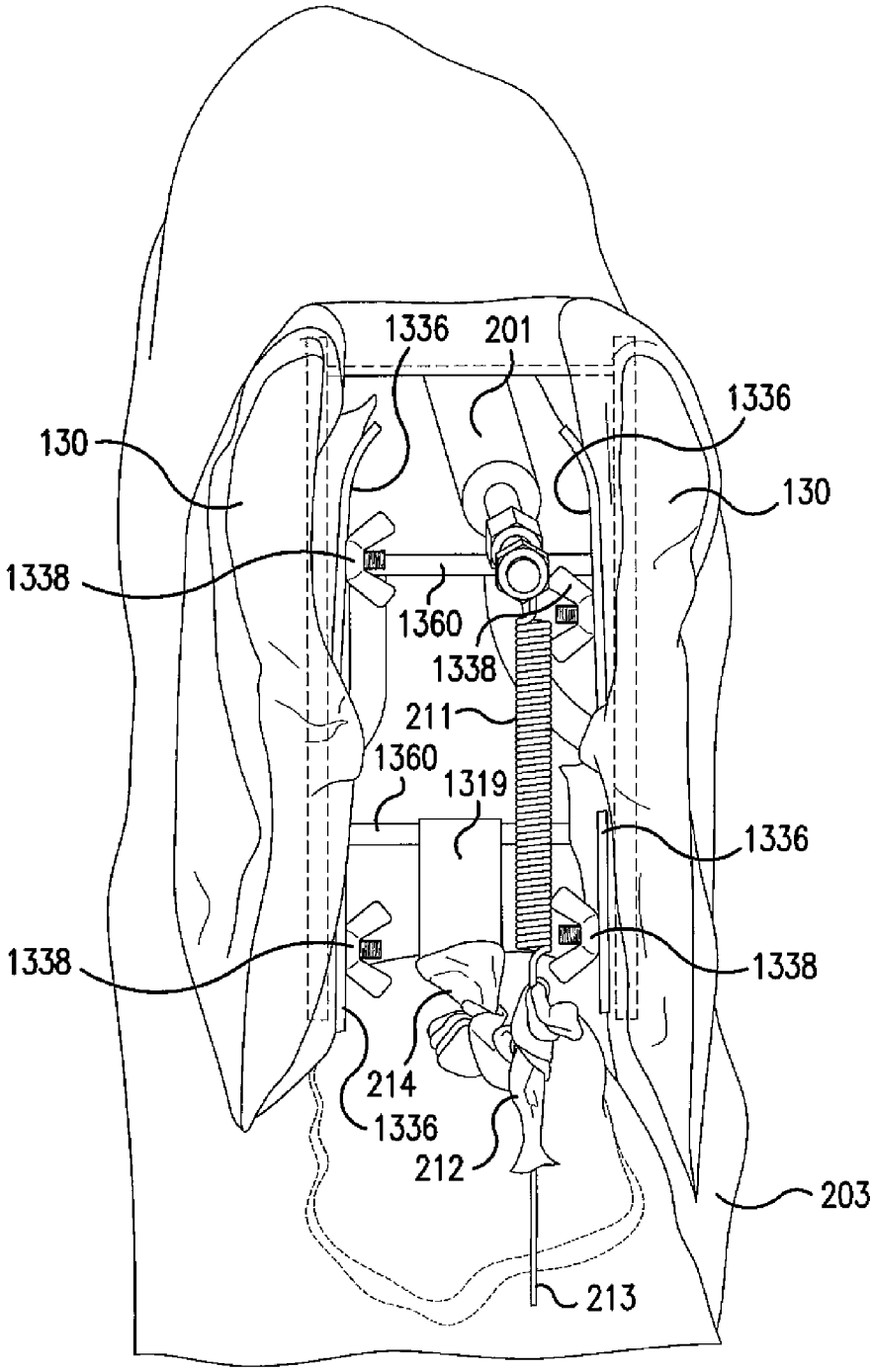
FIG. 4E is a side perspective view of an exemplary embodiment of the invention showing details of the side air bag, two shoulder expander air bags, a shoulder air bag expander frame, and side air bag extender elements in an expanded position.
Figure 4F:
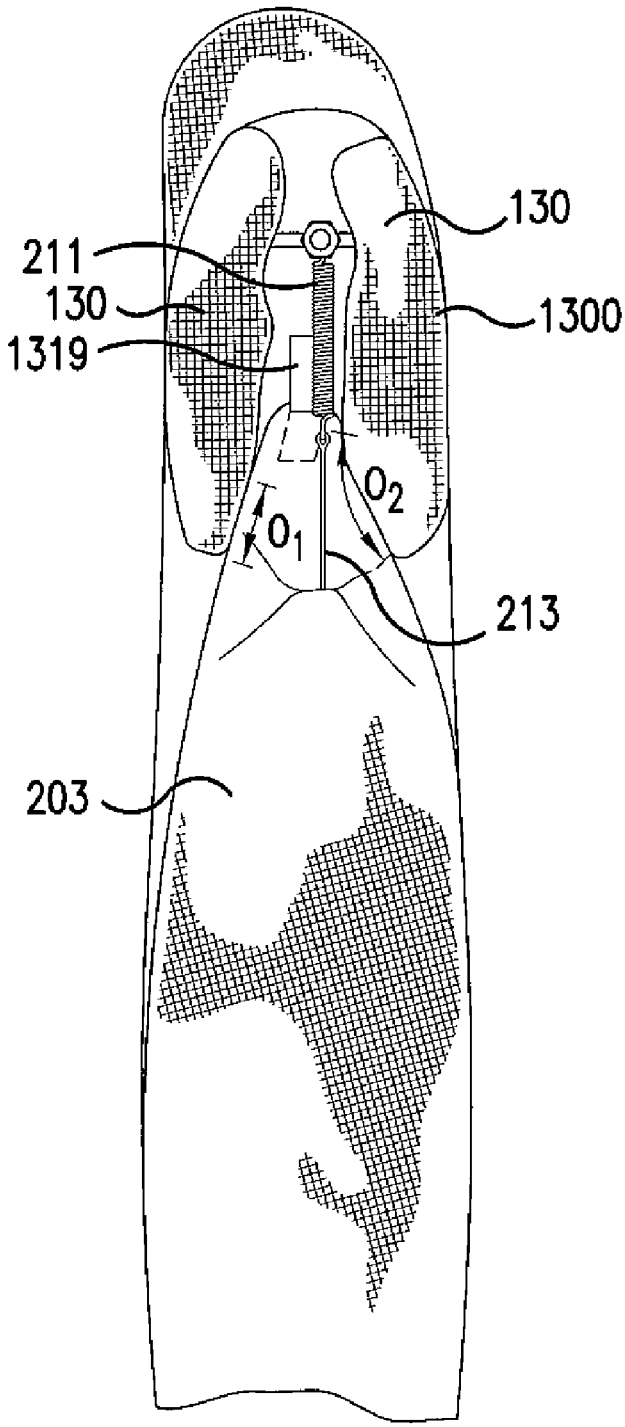
FIG. 4F is a side view of an exemplary embodiment of the invention showing details of the side air bag, two shoulder expander air bags, a shoulder air bag expander frame, and side air bag extender elements in a retracted position.

FIGS. 4D, 4E and 4F are pictorial views of an actual exemplary embodiment of the invention and clearly show a number of details of the shoulder extender mechanisms 130 and extendable resilient elements 1300, including their relative sizes and shapes and how they fit with side air bags 203. FIG. 4D shows, for example, shoulder rod spring 211, which is connected to a shoulder rod (not shown in FIG. 4D, but shown, for example, in FIG. 1 as element 201). FIG. 4D also shows side air bag 203 connected by tie 214 to side air bag extender element 1319 which is connected to second shoulder extender 131 (not illustrated in the figure, but just below the top surface or side airbag 203. Also shown in FIG. 4D, tether 212 is tied to shoulder extension spring and stitched to 203. FIG. 4D also shows air hose 1350 connected to air inlet 1352 of a shoulder air bag 133, and two cover flap securing plates 1336, and one cover flap securing plate fastener 1338 which, in this exemplary embodiment is a bolt and wing nut assembly, but may be any suitable fastening means.

FIG. 4E shows an end view, in perspective, of an exemplary working embodiment of the invention with similar elements labeled accordingly.

FIG. 4F shows another end view, in perspective of an exemplary working embodiment of the invention which shows typical overlapping areas $O_1$ and $O_2$ of the should air bag 130 comes into direct contact with air bag 203.

Figure 4G:
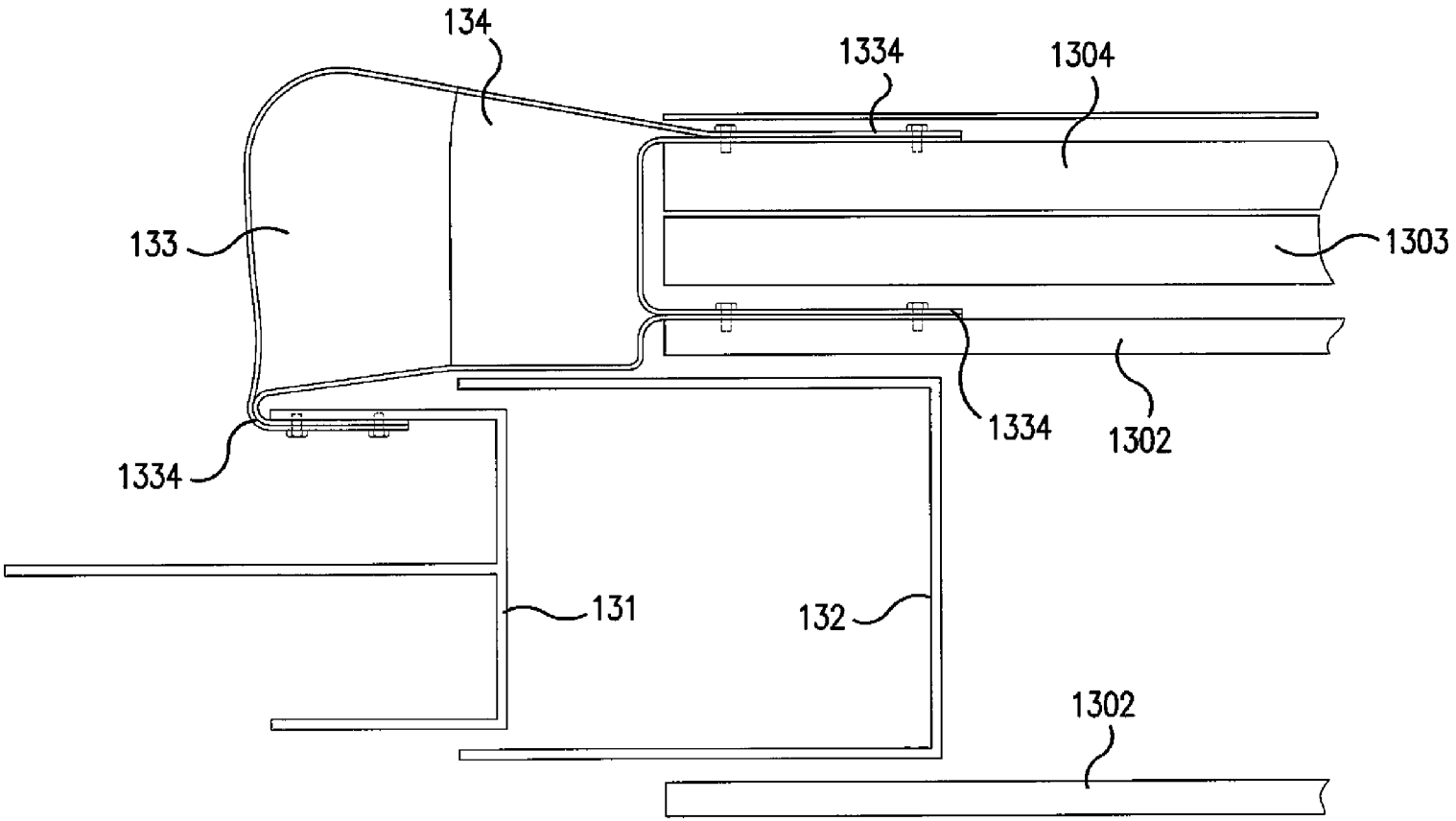
FIG. 4G is a top enlarged view of one exemplary embodiment of the shoulder expansion device.

FIG. 4G presents a vertical cutaway view of one exemplary embodiment of expander elements 130.

In this exemplary embodiment of an expander element 130, a relatively thick, e.g., ¼-⅜ inch thick, cotton pad 1304 contacts a relatively thick, e.g., ⅜ inch thick, silicone rubber pad 1303. Pad 1303 contacts a rigid support plate 1302 made, for example, from a plastic such as, for example polymethylmethacrylate (PMMA), or a rigid metal. On the other side of the rigid support plate 1302 are shoulder expander frames 131, 132. Flaps 1334 of the air bags are used to attach the air bags 133, 134 to the shoulder expander frame 131 and the cotton pad 1304 and rigid frame 1302.

Figure 5A:
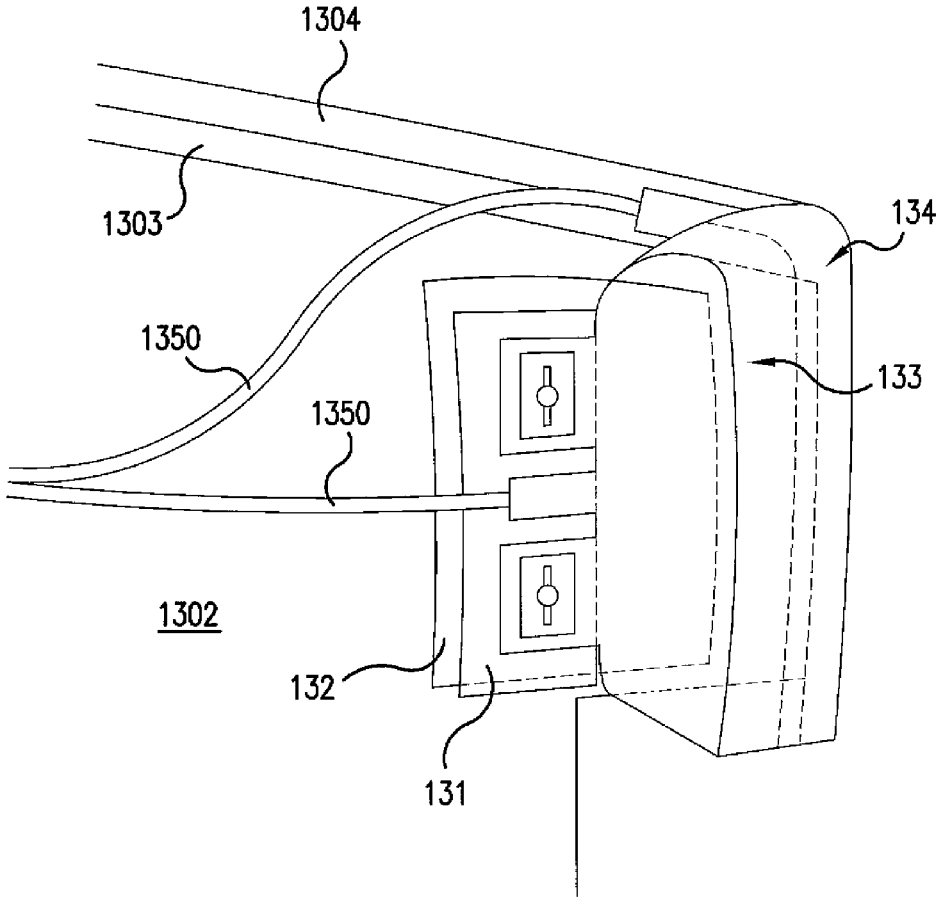
FIGS. 5A-5C are perspective views of one side of an exemplary embodiment of a shoulder expansion device in different stages of expansion/retraction.
Figure 5B:
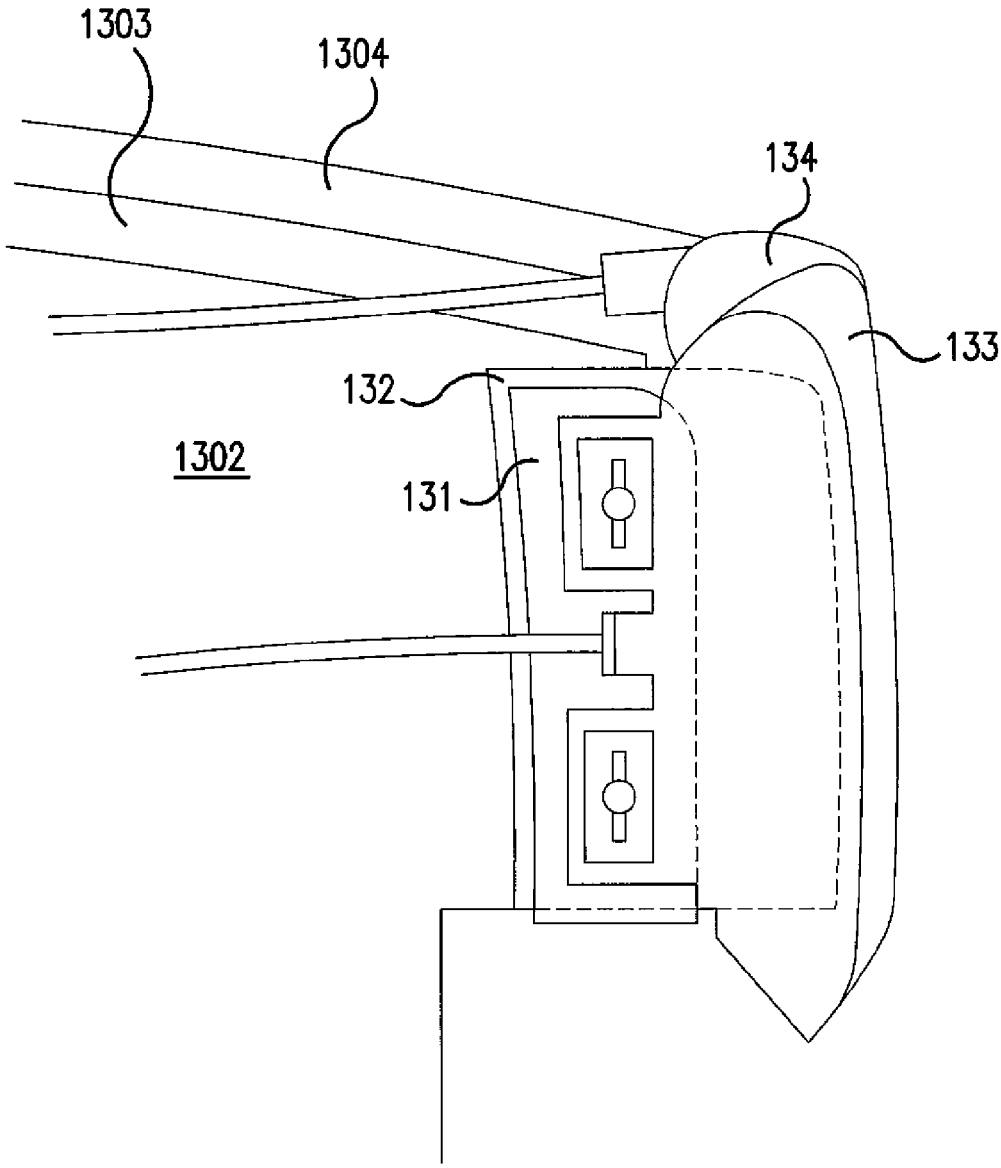
Figure 5C:
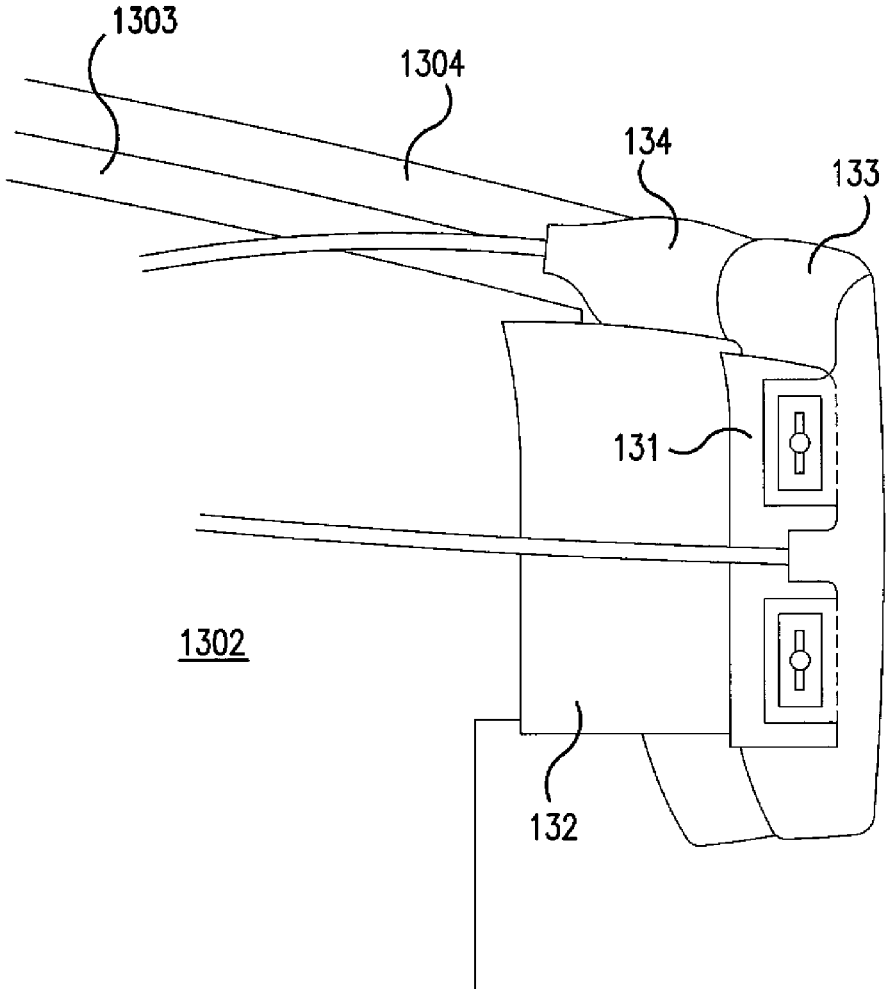
Figure 5D:
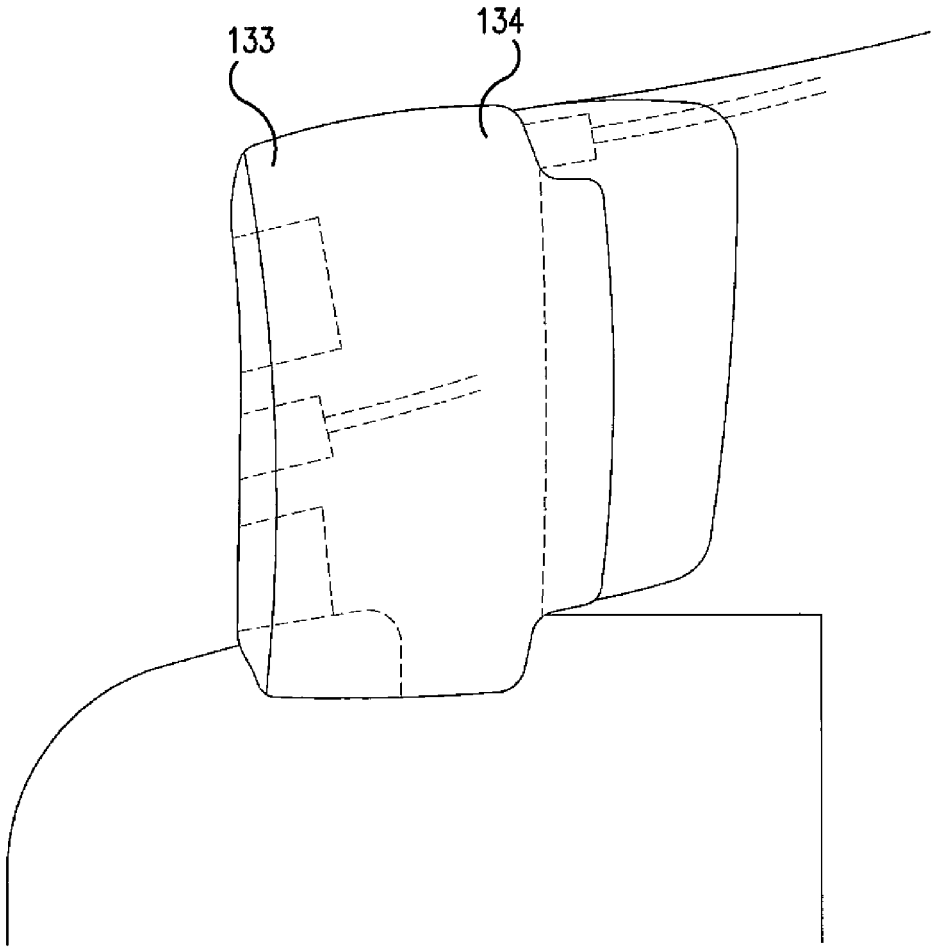
FIG. 5D is a perspective view of an opposite side of the exemplary embodiment of the shoulder expansion device shown in FIGS. 5A-5C.

FIG. 5A is a perspective view of one side of an exemplary embodiment of a shoulder expansion device, in a fully retracted position and FIG. 5B is a perspective view of the exemplary embodiment of the shoulder expansion device in a first extended position, FIG. 5C is a perspective view of the exemplary embodiment in a fully extended position, and FIG. 5D is a perspective view of an opposite side of the exemplary embodiment in the fully extended position. These figures clearly show an actual exemplary embodiment of shoulder extension frames 131, 132 in detail, including details of the shoulder extender air bags 133, 134, air inlets, and rigid frame 1302.

Actual dimensions of one actual exemplary embodiment of the inventions are listed in Table 1.

TABLE 1

| Element/Feature | Height | Width/Thickness | Length | Shape |
|---|---|---|---|---|
| Shoulder Extender Air Bags | 7" | ⅝" | 1" each | Columnar |
| Flexible Rubber Layers | 7" | ⅝" total (12 layers) | 2" | U-shaped |

FIGS. 6A, 6B and 6C show details of an actual exemplary embodiment of the invention. These details include pneumatically operated support elements 1050-1090 for shoulder expander elements 130. Pneumatically operated support elements 1050-1090 are shown for only one side of the buck 200, but it is understood that similar pneumatically operated support elements are provided for both sides of the buck 200. This exemplary embodiment, as discussed above, employs two stage expander mechanisms 130.

Operation of the two-stage expander mechanism exemplary embodiment shown in FIGS. 6A-6C is explained with respect to the left side of the shirt presser 10 but it is understood that the right side of the shirt presser 10 operates in a complementary manner at the same time.

The left side first cylinder 1090 is operated to extend first cylinder shaft 1090S and piston 1090P a distance x to the left. This results in the following sequences of events:

(1) Because the first cylinder piston 1090P is fixedly connected to the first expander frame drive shaft 1080 by connector B3, the first expander 132 is extended a distance x to the left, i.e., outward and away from the center of the buck 200.

(2) Because the first cylinder piston 1090P is also fixedly connected to second cylinder drive shaft 1070S by connector B3, both the second cylinder 1070 and the second cylinder drive shaft 1070S are moved a distance x to the left, i.e., outward and away from the center of the buck 200 to the left.

(3) Because the second cylinder piston 1070P is fixed to the second expander 131 via center drive shaft 1060 (which is fastened at one end to the second expander 131), the second expander drive shaft 1060 and the second expander 131 are moved a distance x to the left, i.e., outward and away from the center of the buck 200 to the left.

(4) Because second expander drive shaft 1060 is fixedly connected to a shoulder rod cylinder 1050 by connector B1, the shoulder rod cylinder 1050 is moved a distance x to the left, i.e., outward and away from the center of the buck 200 to the left.

The movement of the second stage is similar to that of the first stage and can be more fully understood from the drawing Figures.

Figure 7:
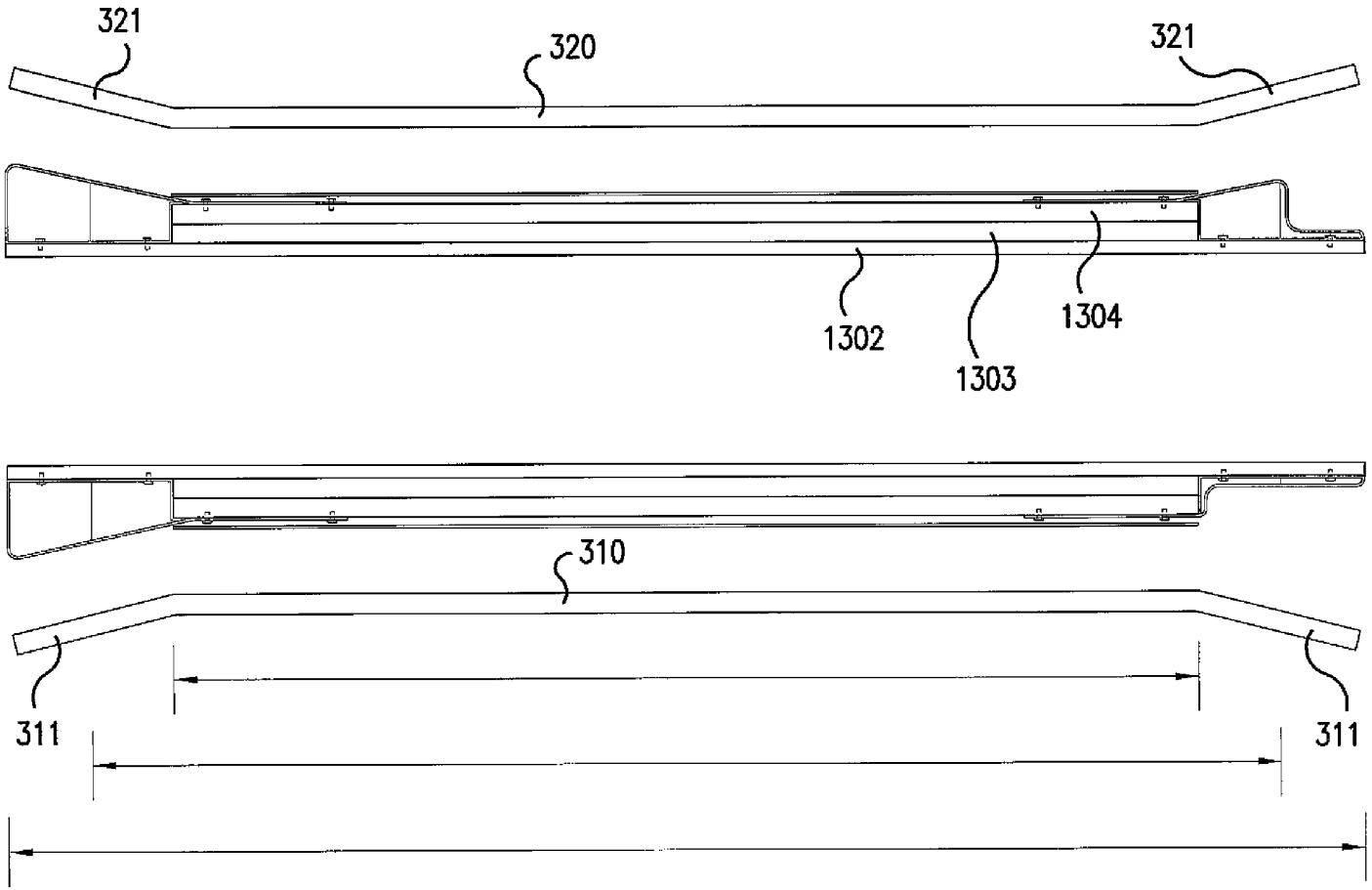
FIG. 7 is a top cutaway view of one exemplary embodiment of a shoulder expander buck of the invention.

FIG. 7 is a top cutaway view of another exemplary embodiment of a shoulder expander buck of the invention, in which the air bags are not expanded outwardly from the center of the buck, but are merely inflated in existing positions. In this exemplary embodiment, instead of using a laterally movable expander mechanism 130, the buck is lengthened to that its length approximately equals length $L_{2E}$ of the shoulder extension mechanism shown in FIG. 4C. Platens 310 and 320 have platen extenders 311 and 321, which extend therefrom at an angle thereto and which face the inflatable air bags of this embodiment. FIG. 8 is a top cutaway view of another exemplary embodiment of a shoulder expander buck of the invention with platen extensions 311 and 321 which extend longitudinally from the platens 310 and 320.

Figure 9A:
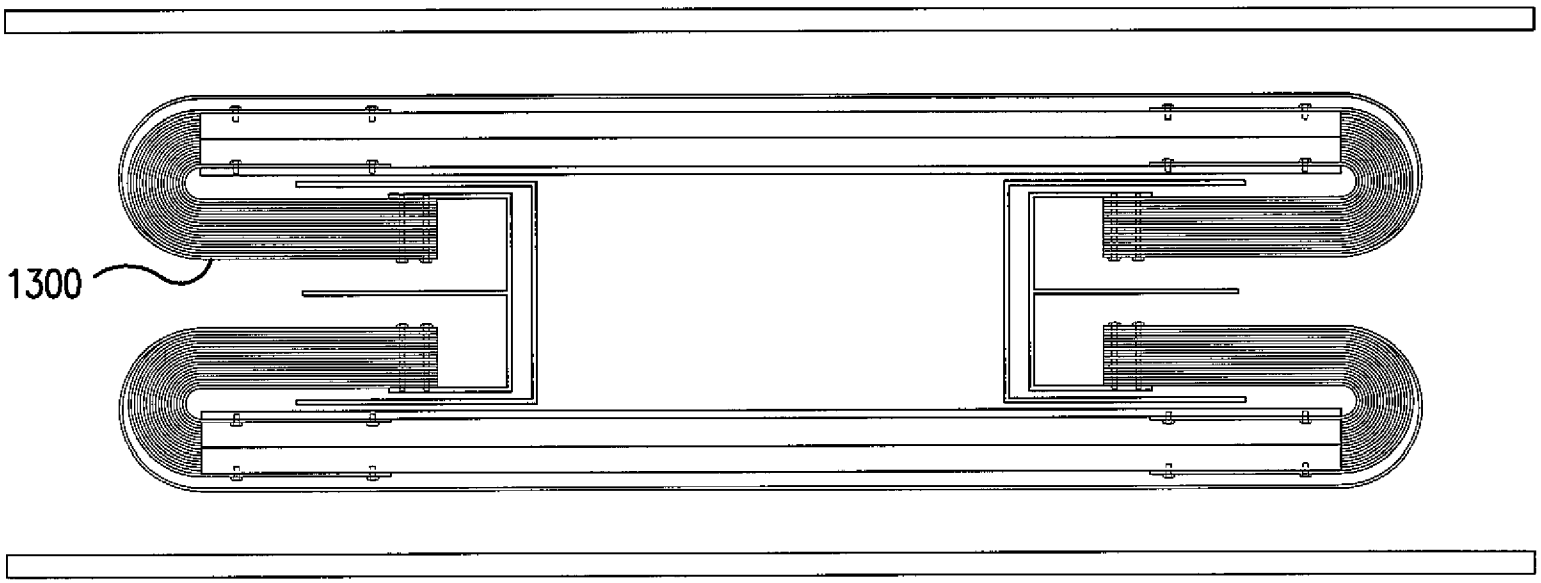
FIGS. 9A-9C are top cutaway views of an exemplary embodiment of a buck with a shoulder expander that employs a plurality of layers of flexible material as an expander element.
Figure 9B:
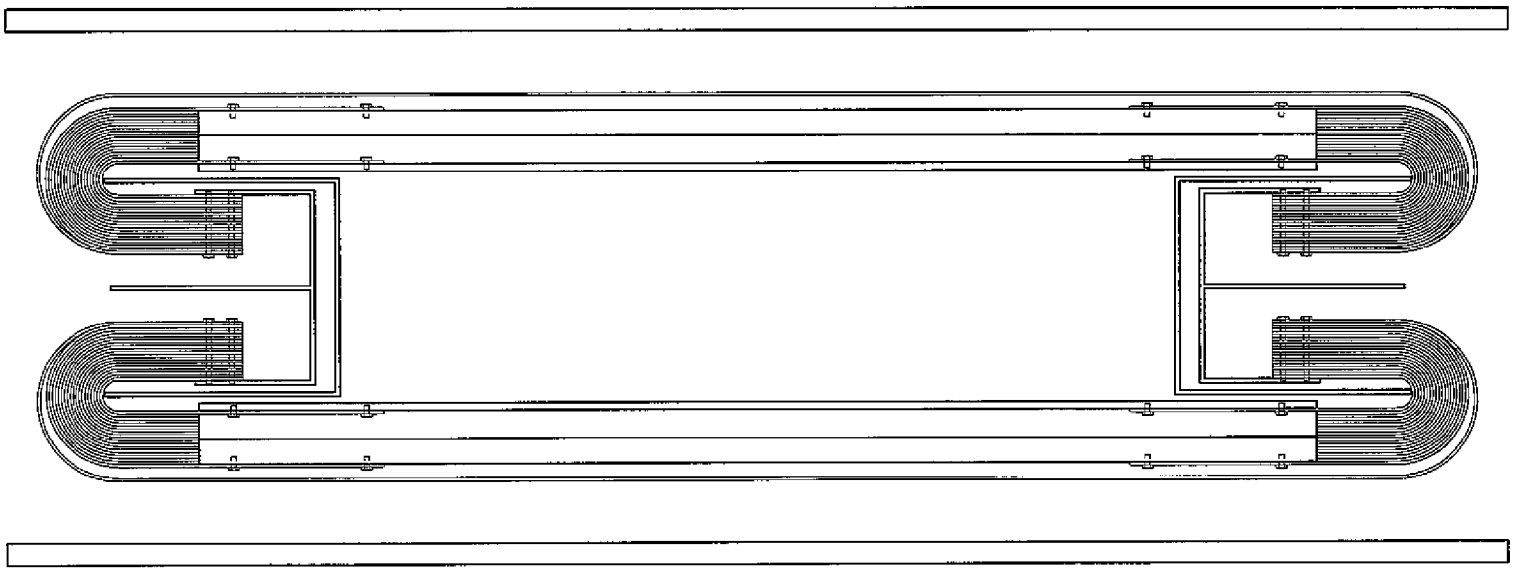
Figure 9C:
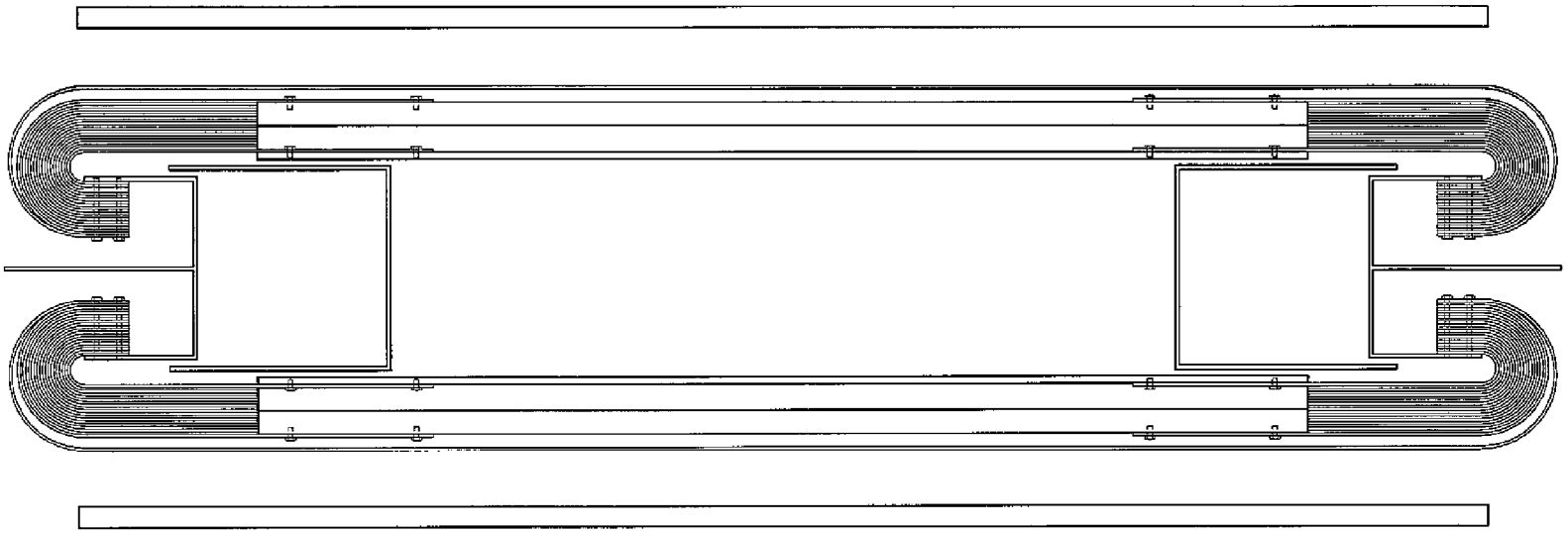

FIGS. 9A through 9C are top cutaway perspective views of an exemplary embodiment of a buck with a shoulder expander having a resilient element 1300 that employs a plurality of layers of flexible material, instead of the air bag exemplary embodiment shown in FIGS. 4A through 4C, as shoulder expander elements 130. In one exemplary embodiment, the resilient element 1300 is made of thin sheets of silicone rubber. In one actual embodiment, twelve of these sheets together measure approximately ⅝ inch in thickness, so each sheet is approximately 1/24 inch thick. The sheets may be connected together with suitable connectors, e.g., pins or rivets, or may be adhesively connected to one another and attached to a movable shoulder extender frame 131, 132, in any suitable manner, including as shown in FIGS. 9A through 9C.

Figure 10B:
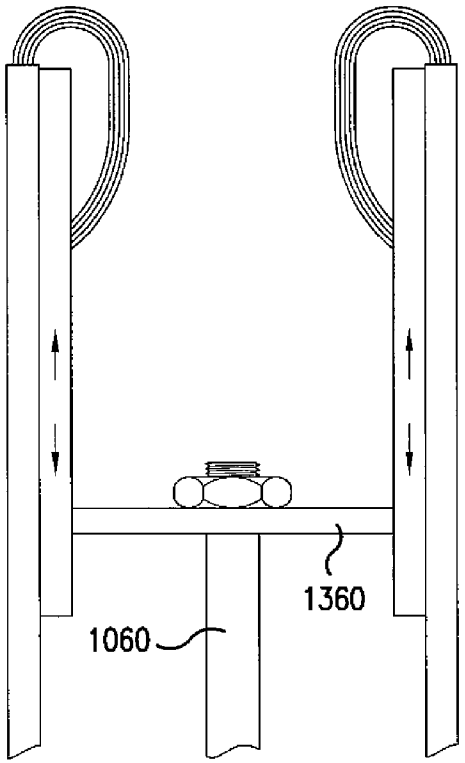
FIGS. 10A and 10B are top cutaway views of a further exemplary embodiment of a buck with a shoulder.
Figure 10A:
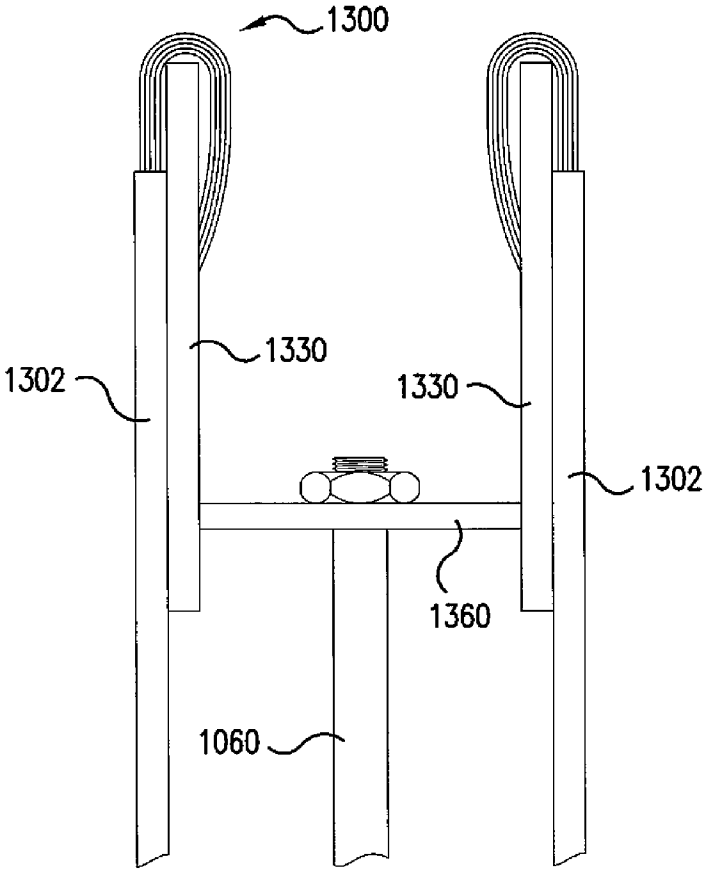

FIGS. 10A and 10B show a second exemplary embodiment similar to that shown in FIGS. 9A through 9C. In this exemplary embodiment, the flexible layers are attached to the inside of the slidable plate 1330 and to the ends of the rigid frame 1302 so that the slidable plate 1330 may move in a continuous manner while the flexible layers provide support at all locations along the movement of the slidable plate 1330.

Figure 11A:
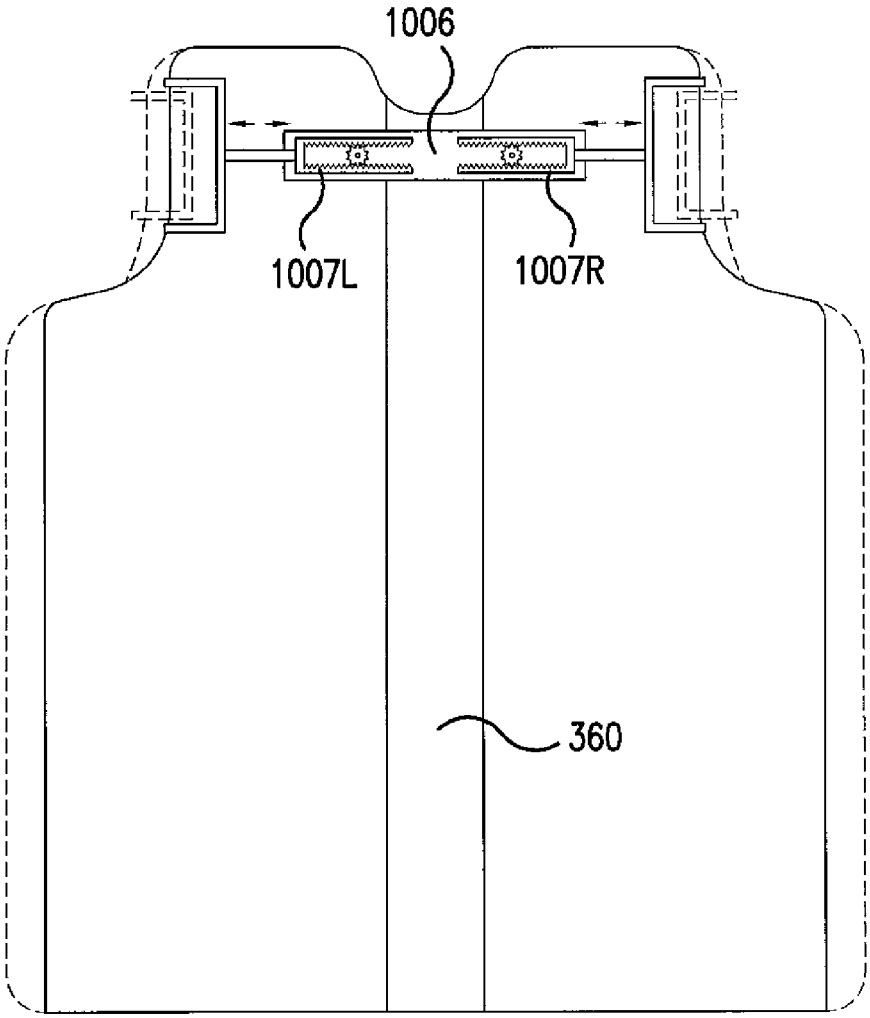
FIGS. 11A and 11B are cutaway views of exemplary embodiments of devices for moving shoulder expanders outwardly from the center of the shirt pressing device.
Figure 11B:
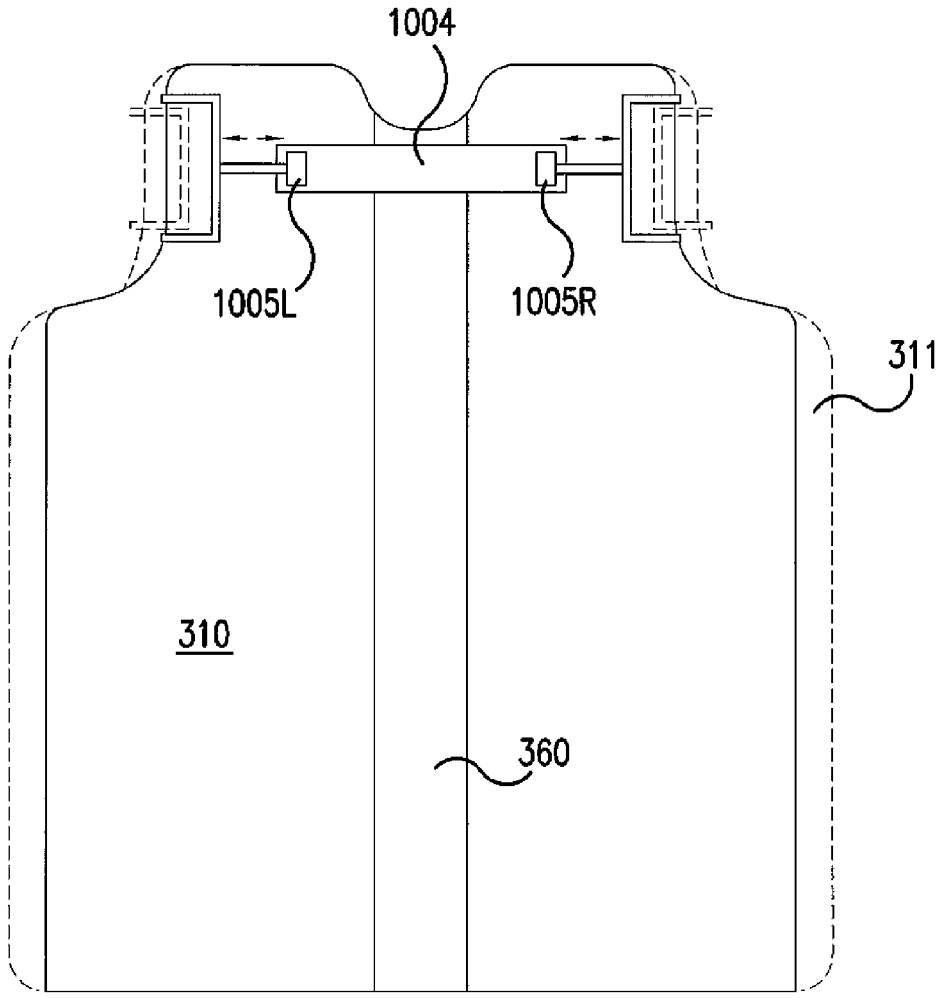
Figure 12:
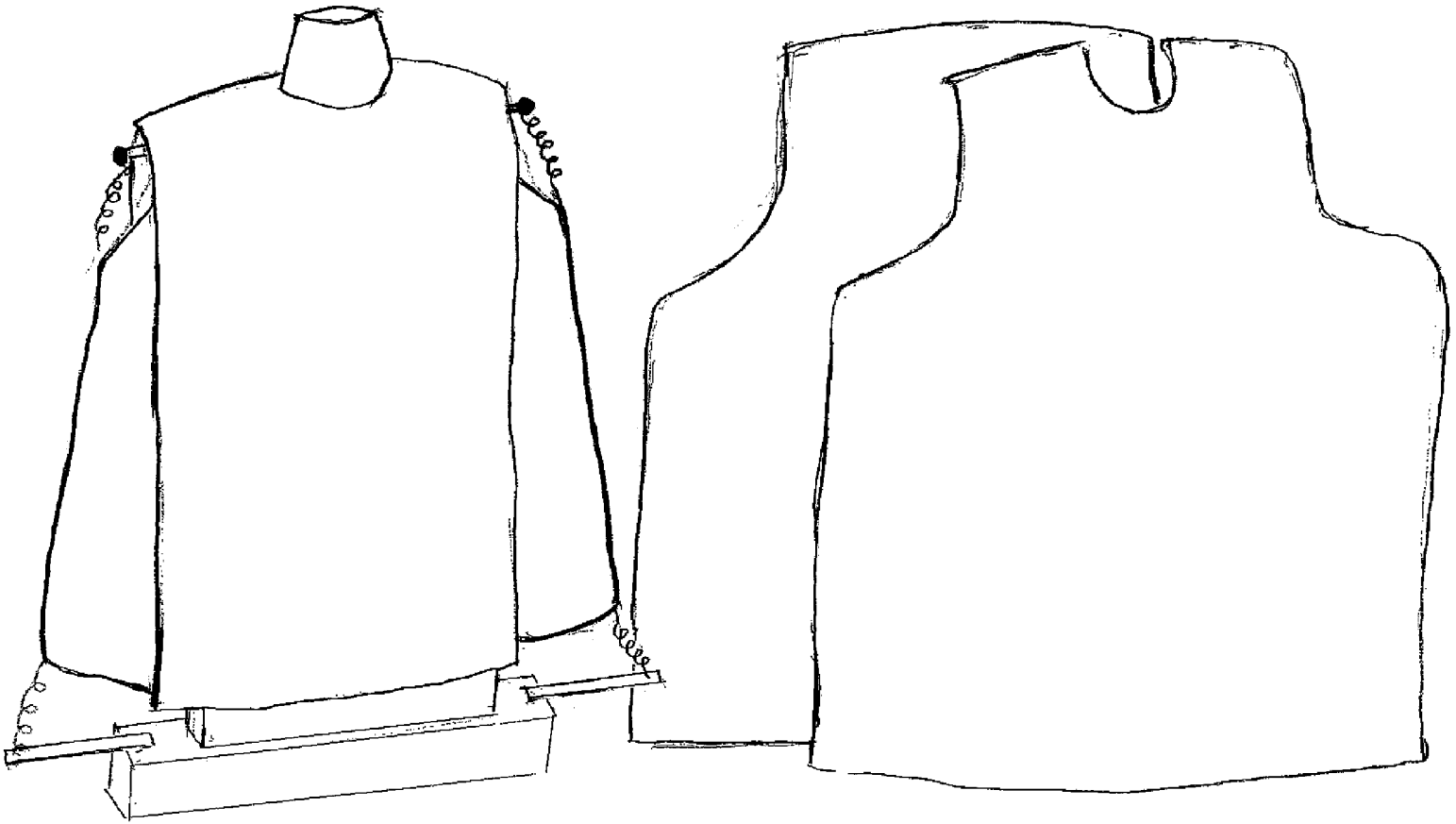
FIGS. 12-25 show various details of the shirt finisher of the invention.
Figure 13:
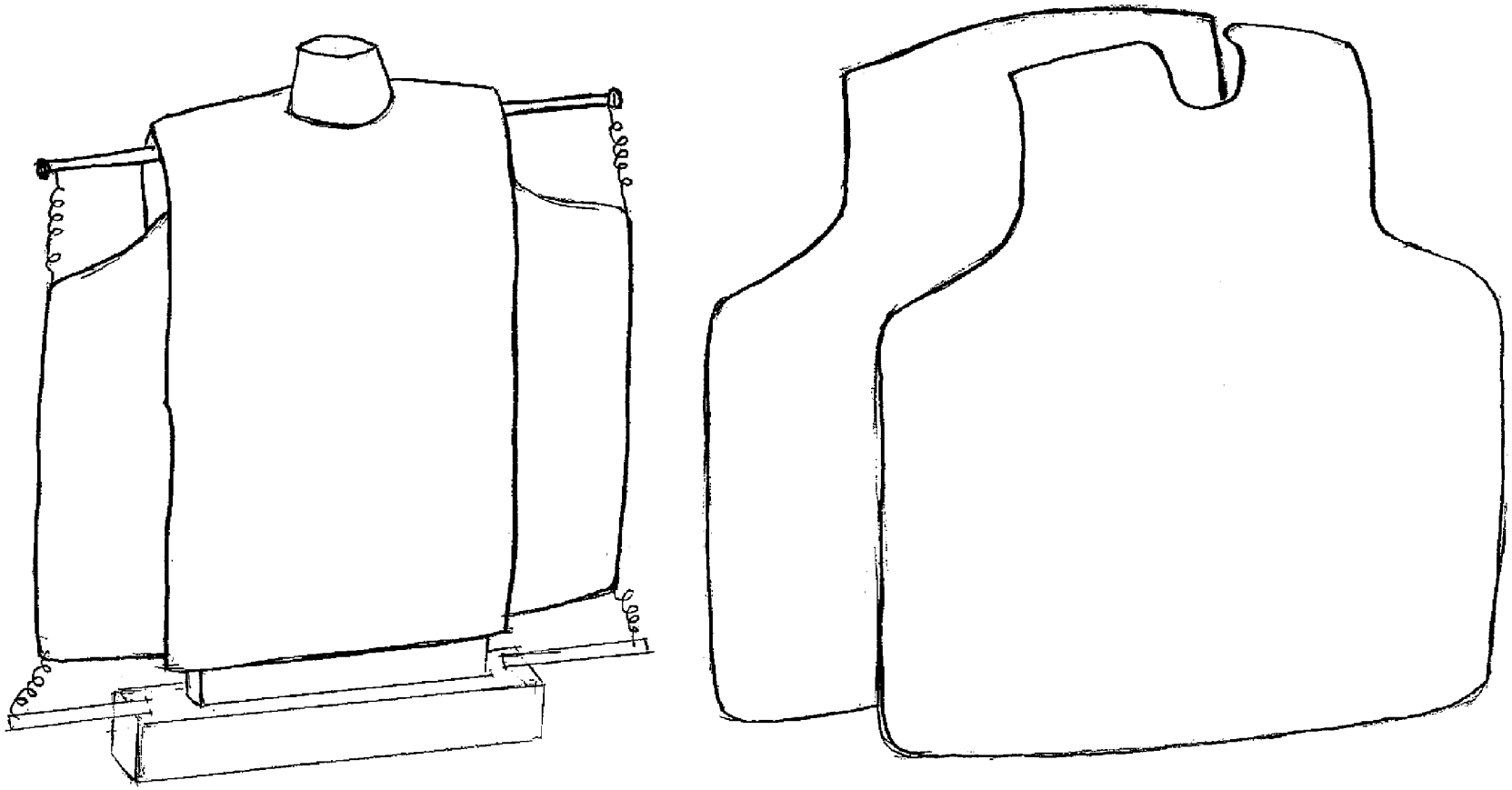
Figure 14:
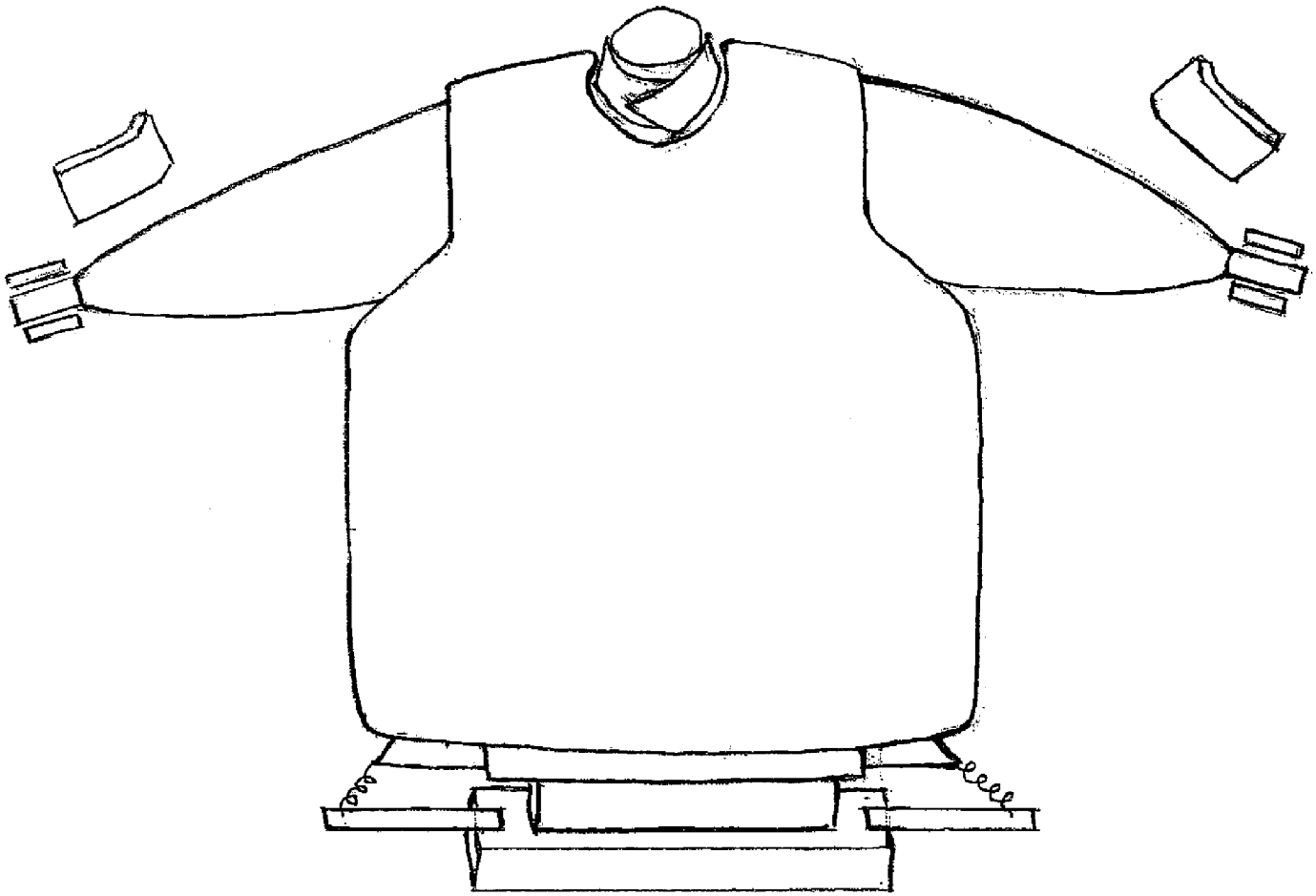
Figure 15:
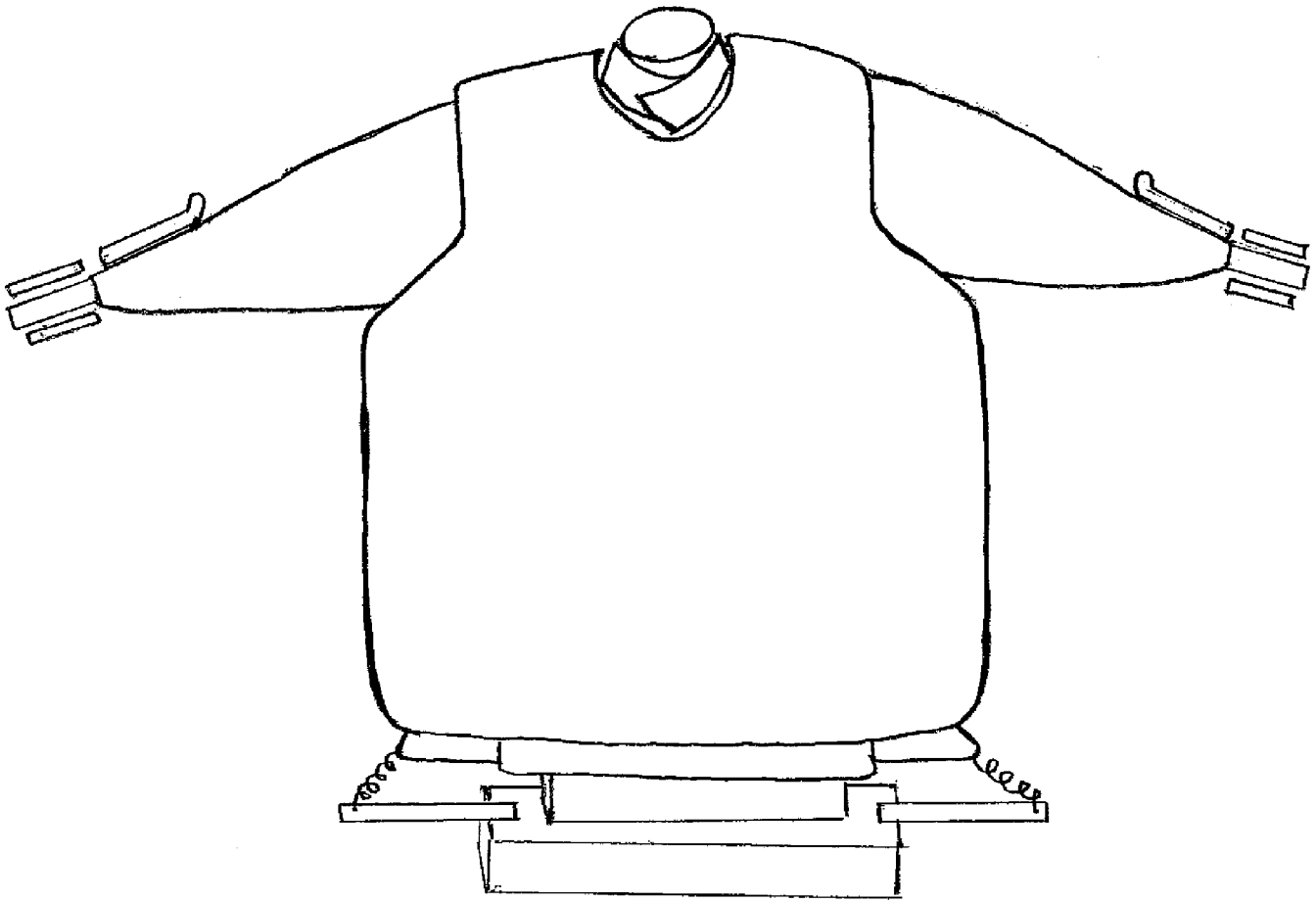
Figure 16:
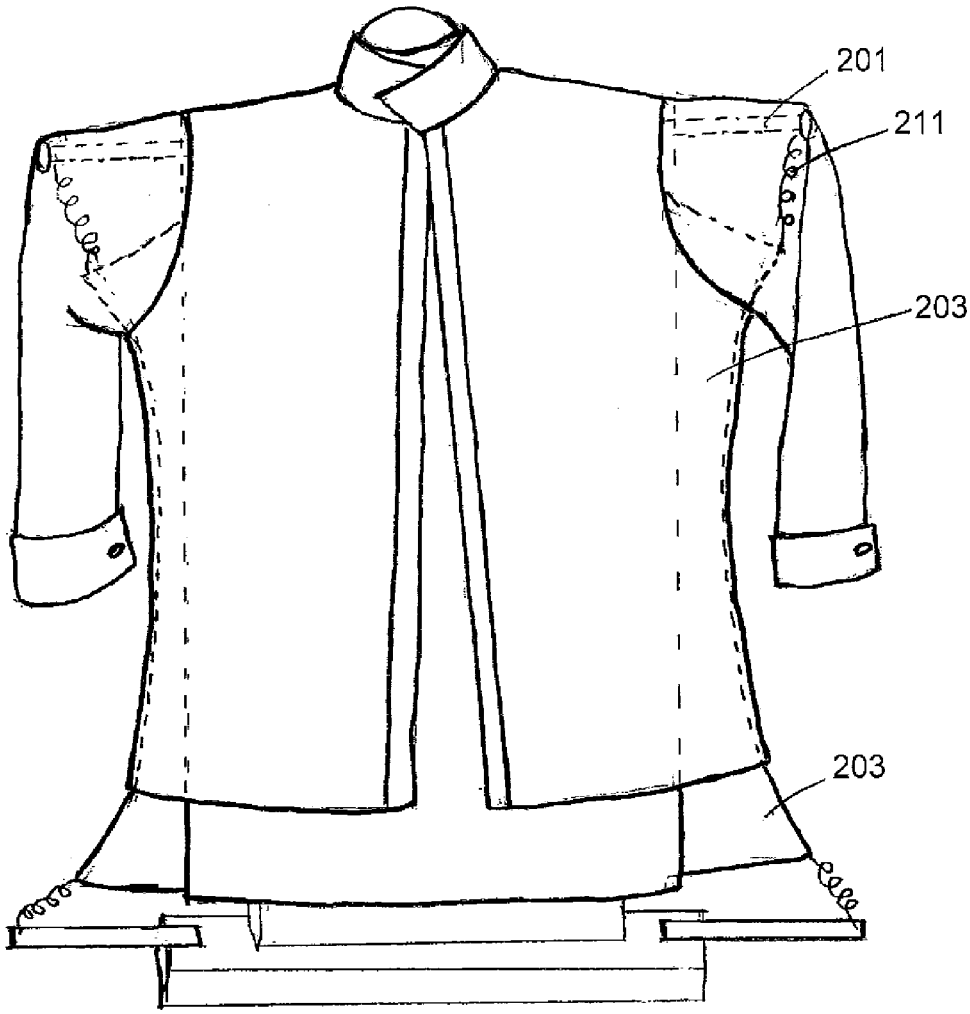
Figure 17:
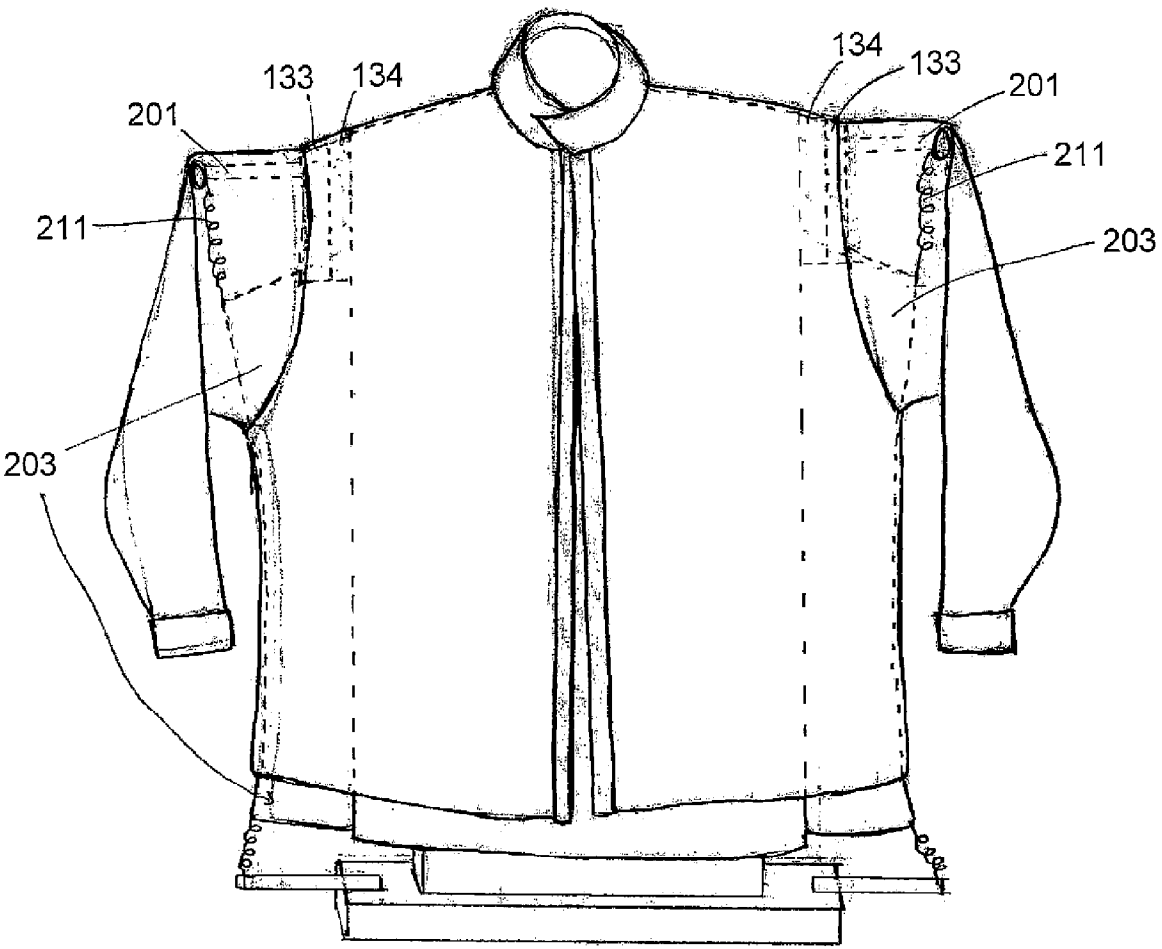
Figure 19:
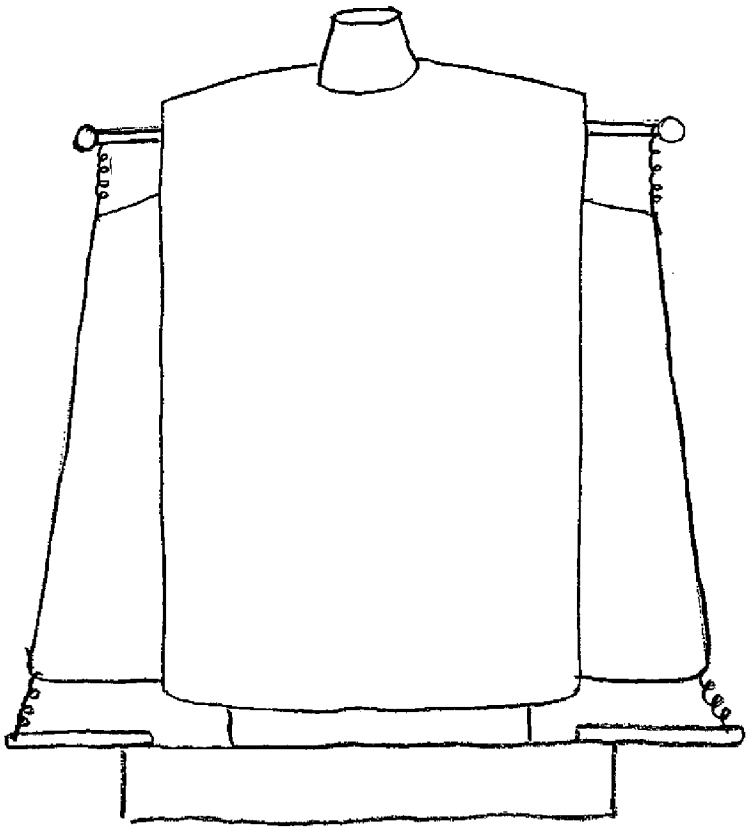
Figure 18:
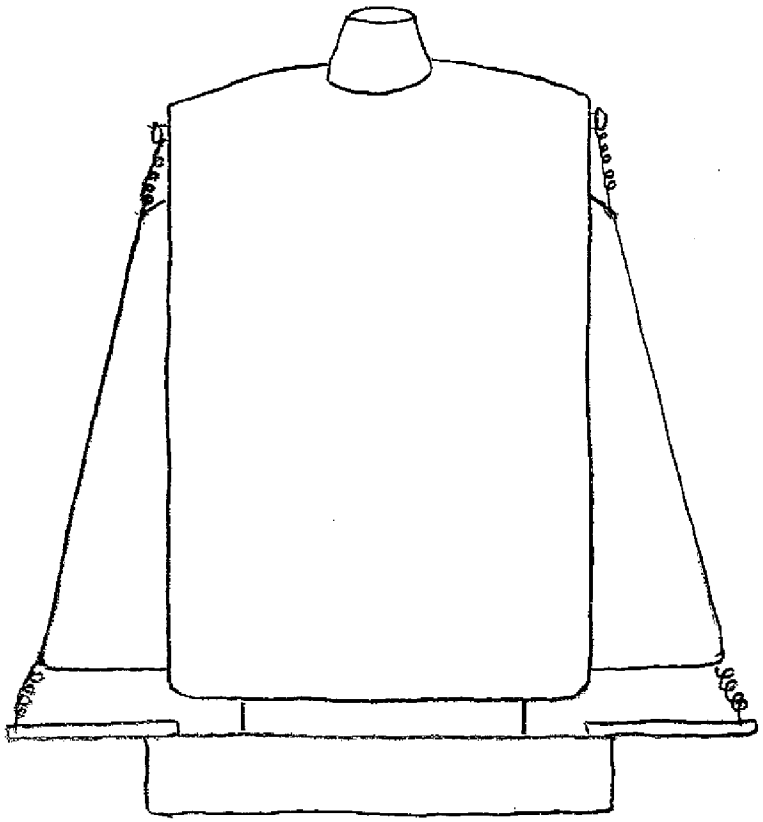
Figure 21:
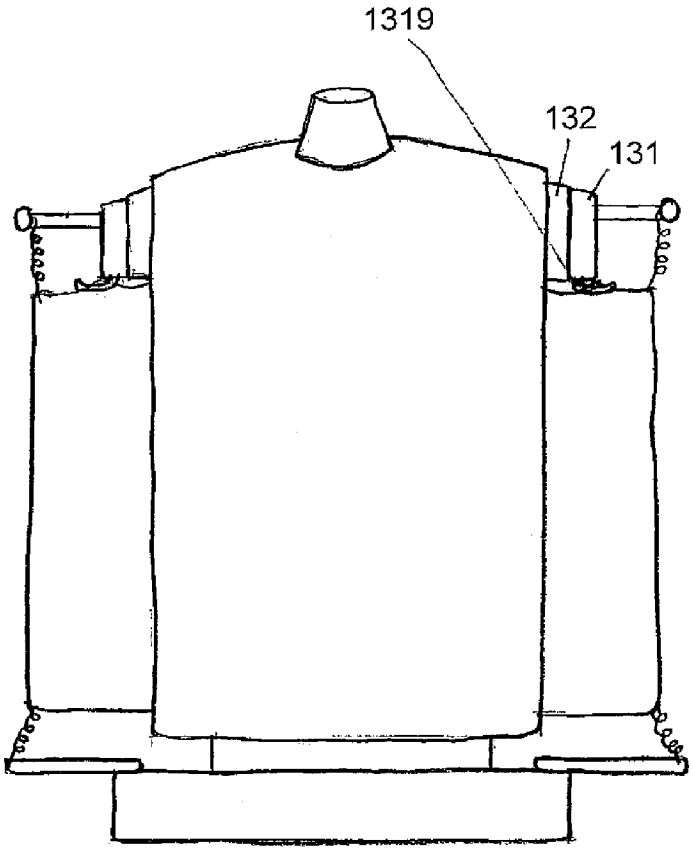
Figure 20:
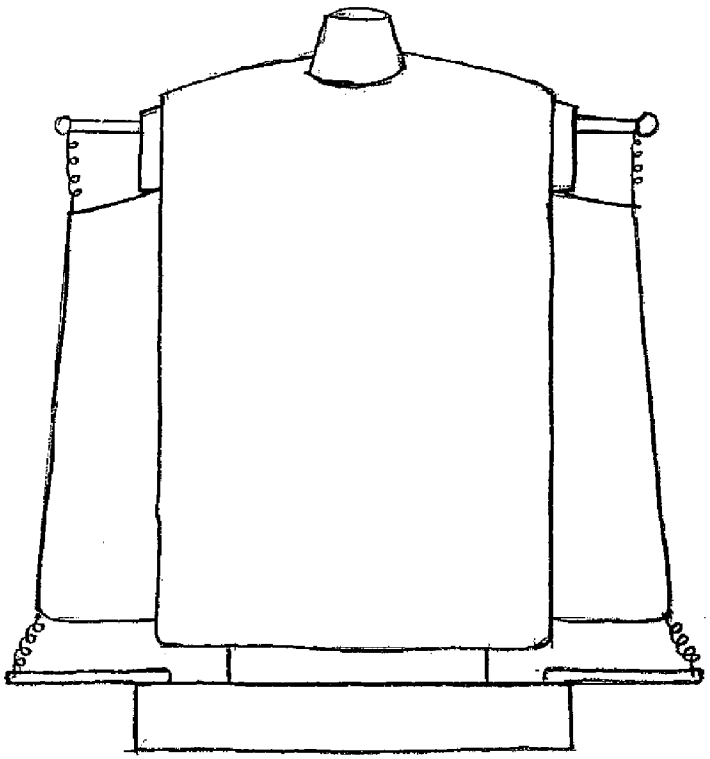
Figure 22:
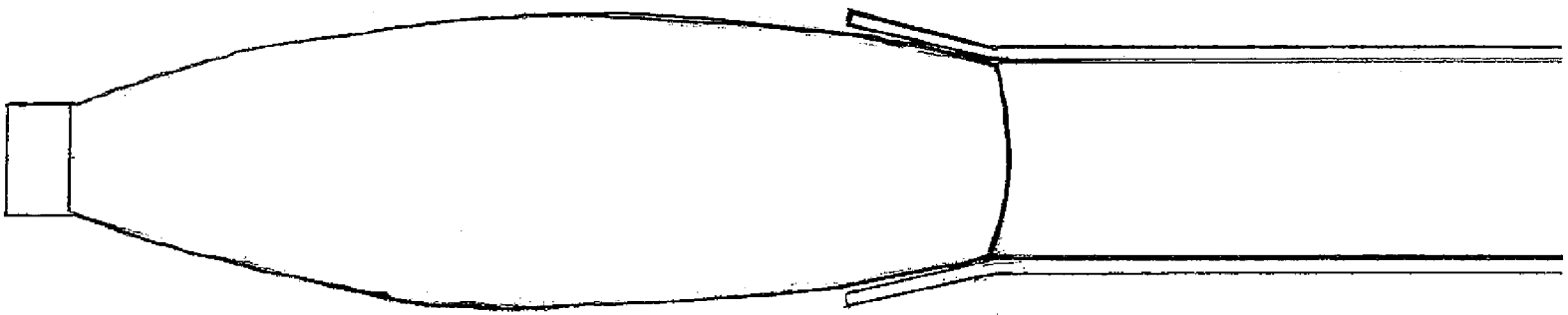
Figure 23:
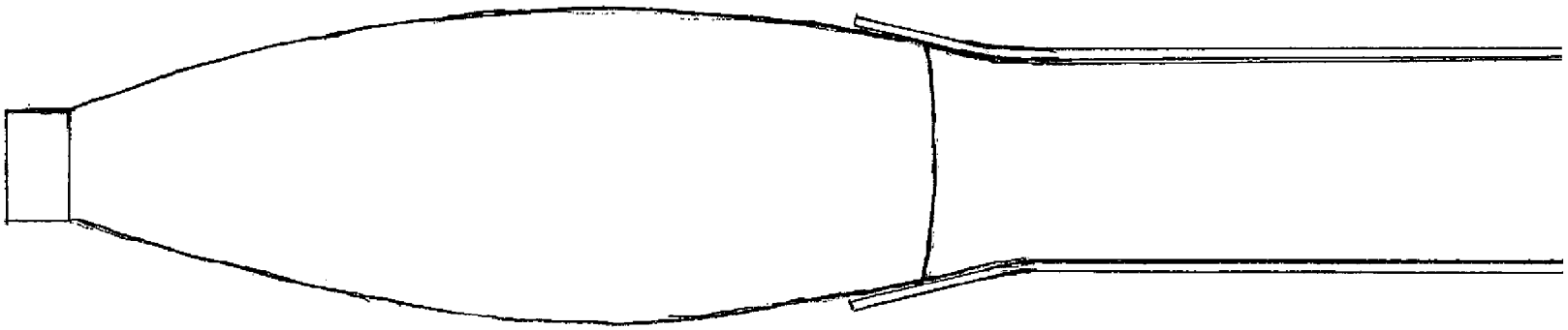
Figure 24:
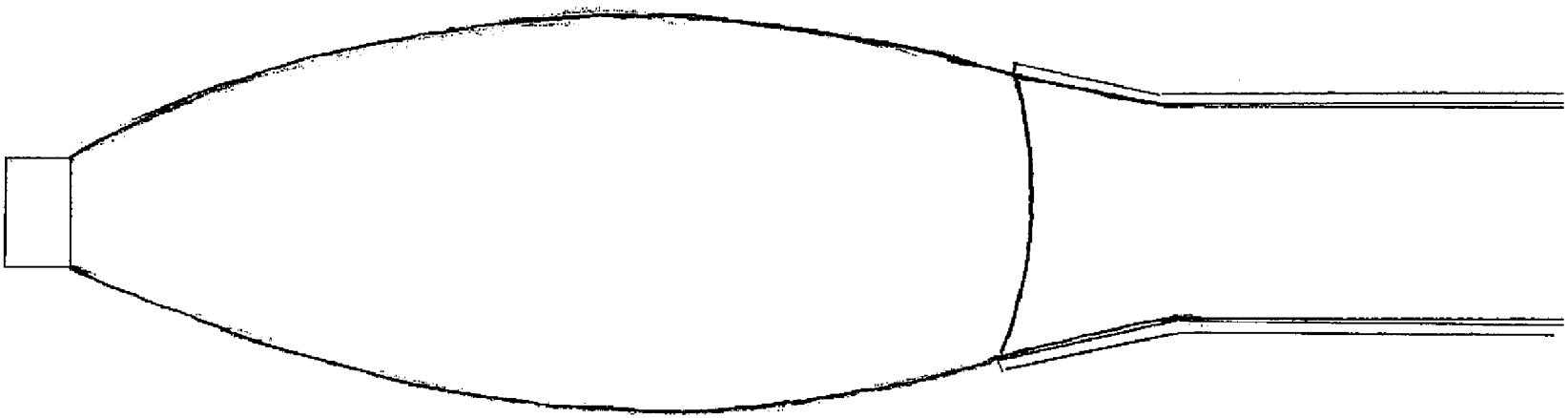
Figure 25:
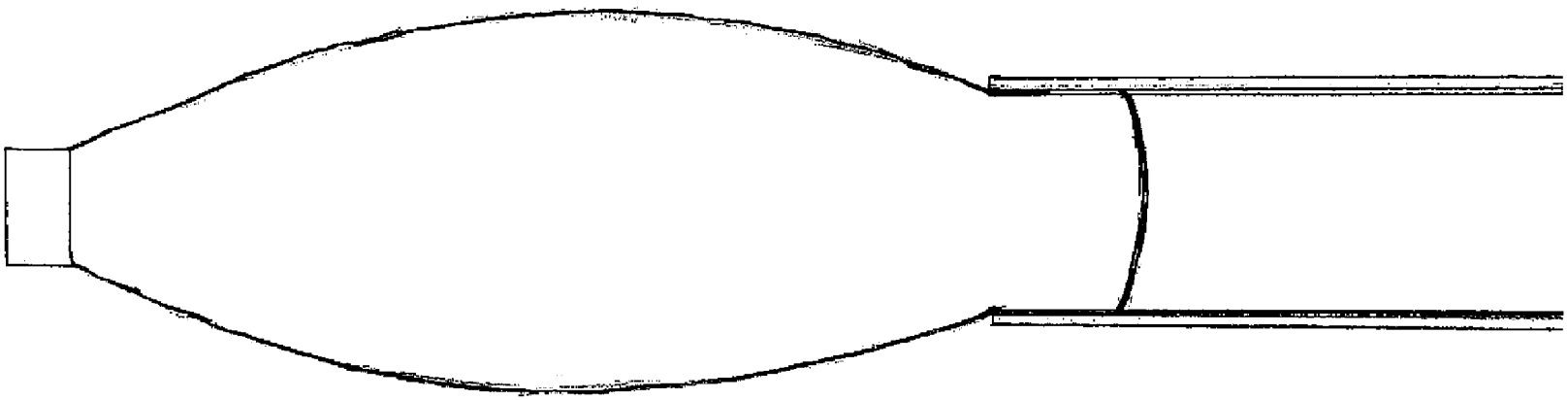

FIGS. 11A and 11B are cutaway views of exemplary embodiments of a shirt pressing device having a single stage shoulder expander, showing a platen with and without side extension portions. In the exemplary embodiment of FIG.

11A, a rack and pinion shoulder extender mechanism drive assembly is shown, whereas in the exemplary embodiment of FIG. 11B, a piston driven shoulder extended mechanism is shown as being mounted to a support frame for moving a single shoulder expanders outwardly from the center of the shirt pressing device from a retracted position to a single expanded position. A vertical support element 360 is provided to support either the piston assembly 1004, which includes pistons 1005L and 1005R, or the rack and pinion drive assembly 1006, which includes rack and pinion gear assemblies 1007L and 1007R.

In a single-stage expander embodiment, as shown, for example, in FIG. 11B, only one expander frame is employed, thereby simplifying the operating mechanism, which only has to use single pistons 1005L or 1005R, and single drive shafts (not shown) for the single expander frame.

In a continuous displacement single expander frame embodiment, as shown, for example, in FIG. 1A, a single expander frame is not driven in increments, but is driven with continuously variable displacement by rack and pinion mechanisms 1010L and 1010R, instead of by a pneumatically driven piston.

FIGS. 12-25 show various details of the shirt finisher of the invention.

It should be appreciated that the shape of pistons used to move the shoulder expander mechanisms can vary and can include rectangular, cylindrical, annular or other suitable shapes.

It should also be appreciated that any suitable material can be used to form the shoulder expander frames including, for example, plastics, metals, rubbers, composites, and laminates. Moreover, shoulder expanders may include padding such as folded cotton layers, folded felt payers, folded rubber sheets, etc.

It should also be understood that the shoulder extenders may be operated not only pneumatically, electrically or electromechanically, but also just mechanically.

Various other modifications may be made to the systems and methods according to the invention that are within the scope of the claims.

I claim:

1. A shirt finisher comprising:

a form for supporting a shirt;

a movable shoulder extender located in the form, movable between a closed position and at least one extended position, the movable shoulder extender including:

a movable frame;

a resilient element provided on the movable frame; and means for moving the movable frame between the closed position and the at least one extended position;

a pressing platen for contact pressing the shirt against the form; and a platen extender positioned to press a portion of the shirt against the resilient element.

2. The shirt finisher of claim 1, wherein the resilient element comprises an air bag.

3. The shirt finisher of claim 1, wherein the resilient element comprises a plurality of layers of flexible material sheets.

4. A shirt finisher comprising:

a form for supporting a shirt;

a movable shoulder extender located in the form, movable between a closed position and at least one extended position, the movable shoulder extender including:

a movable frame;

a resilient element provided on the movable frame; and means for moving the movable frame between the closed position and the at least one extended position; and a pressing platen for contact pressing the shirt against the form, wherein the form includes a side air bag, and the movable frame includes an element for extending the side air bag away from the center of the form.

5. The shirt finisher of claim 1, further comprising means to move the movable shoulder extender in a step-wise manner.

6. The shirt finisher of claim 1, further comprising means to move the movable shoulder extender in a continuous manner.

7. The shirt finisher of claim 5, wherein the step-wise manner is a two-step manner.

8. The shirt finisher of claim 1 wherein the platen extender includes a curved portion at a junction between the platen and the platen extender.

9. The shirt finisher of claim 1 wherein the platen extender extends from the platen at a first angle with respect thereto.

10. The shirt finisher of claim 2 wherein the air bag conforms to the contour of the platen extension.

11. A shirt finisher comprising:

a form for supporting a shirt;

a movable shoulder extender located in the form, movable between a closed position and at least one extended position, the movable shoulder extender including:

a movable frame;

a resilient element provided on the movable frame; and means for moving the movable frame between the closed position and the at least one extended position; and a pressing platen for contact pressing the shirt against the form, wherein the resilient element comprises an air bag, and wherein the shirt finisher comprises a plurality of said air bags, the air bags being selectively inflatable such that shirts of different shoulder widths may be accommodated and pressed against said platen.

12. The shirt finisher of claim 11, wherein at least a first pair of air bags and a second pair of air bags are provided such that a shirt of a first shoulder width may be accommodated and pressed with said first pair of air bags and said second pair of air bags uninflated, a shirt of a second shoulder width larger than the first shoulder width may be accommodated and pressed with said first pair of air bags inflated and second pair of air bags uninflated, and a shirt of a third shoulder width larger than the second shoulder width may be accommodated and pressed with the first and second pair of air bags inflated.

* * * * *